US005179929A

United States Patent [19]

Miyashita et al.

[11] Patent Number: 5,179,929

[45] Date of Patent: Jan. 19, 1993

[54] METHOD OF DETECTING DETERIORATION OF EXHAUST GAS INGREDIENT CONCENTRATION SENSOR

[75] Inventors: Yukio Miyashita; Hiroshi Ohno; Kunio Noguchi; Hironao Fukuchi, all of Wako, Japan

[73] Assignee: Honda Giken Kogyo K.K. (Honda Motor Co., Ltd, in English), Tokyo, Japan

[21] Appl. No.: 796,415

[22] Filed: Nov. 22, 1991

[30] Foreign Application Priority Data

Nov. 29, 1990 [JP] Japan ..... 2-331143

[51] Int. Cl.[5] ..... F02D 41/14

[52] U.S. Cl. ..... 123/688

[58] Field of Search ..... 123/489, 440, 479, 434, 123/435, 436, 688; 364/431.05, 431.06, 431.07

[56] References Cited

U.S. PATENT DOCUMENTS

| | | | |
|---|---|---|---|
| 4,121,548 | 10/1978 | Hattori et al. | 123/489 |
| 4,131,089 | 12/1978 | Fujishiro et al. | 123/489 |
| 5,048,494 | 9/1991 | Fujimoto et al. | 123/489 |
| 5,052,361 | 10/1991 | Ono et al. | 123/489 |
| 5,053,968 | 10/1991 | Uchinami | 364/431.05 |
| 5,065,728 | 11/1991 | Nakaniwa | 123/440 |
| 5,070,847 | 12/1991 | Akiyama et al. | 123/489 |
| 5,094,214 | 3/1992 | Kotzan | 123/479 |

*Primary Examiner*—Raymond A. Nelli
*Attorney, Agent, or Firm*—Arthur L. Lessler

[57] ABSTRACT

A method of detecting deterioration of an exhaust gas ingredient concentration sensor for use in controlling an air-fuel ratio of a mixture supplied to an internal combustion engine having an exhaust system in which the sensor is arranged. The sensor has an output characteristic approximately proportional to concentration of a specific ingredient in exhaust gases emitted from the engine. The air-fuel ratio is feedback-controlled to a desired air-fuel ratio by calculating an amount of fuel supplied to the engine by the use of a desired air-fuel ratio coefficient indicative of the desired air-fuel ratio and set in dependence on operating conditions of the engine, and an air-fuel ratio correction coefficient set in dependence on a value of an output from the sensor and the desired air-fuel ratio coefficient. A plurality of average values of the air-fuel ratio correction coefficient are calculated, respectively, when the desired air-fuel ratio falls within a plurality of predetermined ranges. The average values thus calculated are compared with each other. A degree of deterioration of the sensor is determined from results of the comparison. Further, a method of feedback-controlling the air-fuel ratio in the above-mentioned manner, in which the value of the output from the sensor is corrected in response to the degree of deterioration thus determined.

14 Claims, 14 Drawing Sheets

METHOD OF DETECTING DETERIORATION OF EXHAUST GAS INGREDIENT CONCENTRATION SENSOR

BACKGROUND OF THE INVENTION

1. Field of the Invention

This invention relates to a method of feedback-controlling the air-fuel ratio of a mixture supplied to an internal combustion engine by the use of an exhaust gas ingredient concentration sensor having an output characteristic approximately proportional to the concentration of an ingredient in exhaust gases, and a method of detecting deterioration of the exhaust gas ingredient concentration sensor for use in the air-fuel ratio control.

2. Prior Art

Conventionally, there has been proposed, e.g. by Japanese Provisional Patent Publication (Kokai) No. 62-203951 an air-fuel ratio control method of feedback-controlling the air-fuel ratio of a mixture supplied to an internal combustion engine (hereinafter referred to as "supply air-fuel ratio) to desired air-fuel ratios dependent upon operating conditions of the engine, by the use of an exhaust gas ingredient concentration sensor having an output characteristic approximately proportional to the concentration of a specific ingredient in exhaust gases emitted from the engine (the so-called proportional output type sensor), which comprises the steps of calculating an air-fuel ratio correction coefficient based upon an output from the exhaust gas ingredient concentration sensor and a desired air-fuel ratio, calculating as a learned value the difference of the value of the calculated air-fuel ratio correction coefficient and a predetermined reference value in each of a steady condition of the engine and a transient condition thereof, and controlling the supply air-fuel ratio by the use of the calculated learned value.

According to the above proposed method, it is possible to compensate for aging changes in the operating characteristics of fuel injection valves, an intake pipe pressure sensor, etc. by means of the above learned value. However, if the exhaust gas ingredient concentration sensor per se has become deteriorated, the output of the sensor no more correctly represents the actual concentration of the ingredient. Therefore, such deterioration cannot be compensated for by means of the learned value.

SUMMARY OF THE INVENTION

It is an object of the invention to provide a method of accurately detecting deterioration of an exhaust gas ingredient concentration sensor of the so-called proportional output type.

It is a further object of the invention to provide a method of properly controlling the supply air-fuel ratio by the use of an exhaust gas ingredient sensor having deteriorated characteristics.

To attain the first-mentioned object, the present invention a method of detecting deterioration of an exhaust gas ingredient concentration sensor for use in controlling an air-fuel ratio of a mixture supplied to an internal combustion engine having an exhaust system in which the sensor is arranged, the sensor having an output characteristic approximately proportional to concentration of a specific ingredient in exhaust gases emitted from the engine, the air-fuel ratio being feedback-controlled to a desired air-fuel ratio by calculating an amount of fuel supplied to the engine by the use of a desired air-fuel ratio coefficient indicative of the desired air-fuel ratio and set in dependence on operating conditions of the engine, and an air-fuel ratio correction coefficient set in dependence on a value of an output from the sensor and the desired air-fuel ratio coefficient.

The deterioration detecting method according to the invention is characterized comprising the steps of:

(1) calculating a plurality of average values of the air-fuel ratio correction coefficient, respectively, when the desired air-fuel ratio falls within a plurality of predetermined ranges;

(2) comparing between the average values thus calculated: and (3) determining a degree of deterioration of the sensor from results of the comparison.

Preferably, the predetermined ranges of the desired air-fuel ratio include a first predetermined range corresponding to a stoichiometric air-fuel ratio, a second predetermined range lying on a rich side with respect to the stoichiometric air-fuel ratio, and a third predetermined range lying on a lean side with respect to the stoichiometric air-fuel ratio, the average values of the air-fuel ratio correction coefficient including first, second and third average values calculated, respectively, when the desired air-fuel ratio falls within the first, second and third predetermined ranges, the step (2) comprising comparing between a first average value of the air-fuel ratio correction coefficient and a second average value thereof, and comparing between the first average value of the air-fuel ratio correction coefficient and a third average value thereof.

More preferably, the step (2) comprises calculating a first ratio between the first average value and the second average value, and a second ratio between the first average value and the third average value, and comparing the first and second ratios thus calculated with respective predetermined values.

Alternatively, the step (2) comprises calculating a first difference between the first average value and the second average value, and a second difference between and first average value and the third average value, and comparing the first and second differences thus calculated with respective predetermined values.

The exhaust gas ingredient concentration sensor typically comprises at least one oxygen-pumping element and at least one cell element, each being composed of a solid electrolytic material having ion conductivity, and a couple of electrodes between which the solid electrolytic material is interposed, a diffusion restricting zone being defined between the oxygen-pumping element and the cell element.

To attain the second-mentioned object, the present invention provides a method of controlling an air-fuel ratio of a mixture supplied to an internal combustion engine having an exhaust system, and an exhaust gas ingredient concentration sensor arranged in the exhaust system, the sensor having an output characteristic approximately proportional to concentration of a specific ingredient in exhaust gases emitted from the engine, the air-fuel ratio being feedback-controlled to a desired air-fuel ratio by calculating an amount of fuel supplied to the engine by the use of a desired air-fuel ratio coefficient indicative of the desired air-fuel ratio and set in dependence on operating conditions of the engine, and an air-fuel ratio correction coefficient set in dependence on a value of an output from the sensor and the desired air-fuel ratio coefficient.

The air-fuel control method according to the invention is characterized by comprising the steps of:

(1) calculating a plurality of average values of the air-fuel ratio correction coefficient, respectively, when the desired air-fuel ratio falls within a plurality of predetermined ranges;

(2) comparing between the average values thus calculated:

(3) determining a degree of deterioration of the sensor from results of the comparison; and (4) correcting the value of the output from the sensor in response to the degree of deterioration thus determined.

Preferably, the step (4) comprises determining first and second sensor output correction coefficients for correcting the value of the output from the exhaust gas ingredient concentration sensor, respectively, on a rich side and on a lean side with respect to a stoichiometric air-fuel ratio, and correcting the value of the output from the sensor by the determined first and second sensor output correction coefficients, when the determined degree of deterioration of the sensor is larger than a predetermined value.

The air-fuel ratio control method may include the step of calculating the amount of fuel supplied to the engine by using average values of the air-fuel ratio correction coefficient in place of the air-fuel ratio correction coefficient when the engine is in predetermined operating regions. Preferably, the average values for calculation of the amount of fuel being calculated separately from the average values calculated for determination of the degree of deterioration at said step (1).

The above and other objects, features, and advantages of the invention will be more apparent from the detailed description taken in conjunction with the accompanying drawings.

BRIEF DESCRIPTION OF THE DRAWINGS

FIG. 6(*b*) is a view showing a table of the other correction coefficient KAFL;

DETAILED DESCRIPTION

The methods according to the invention will now be described in detail with reference to the drawings showing an embodiment thereof.

Figure 1:
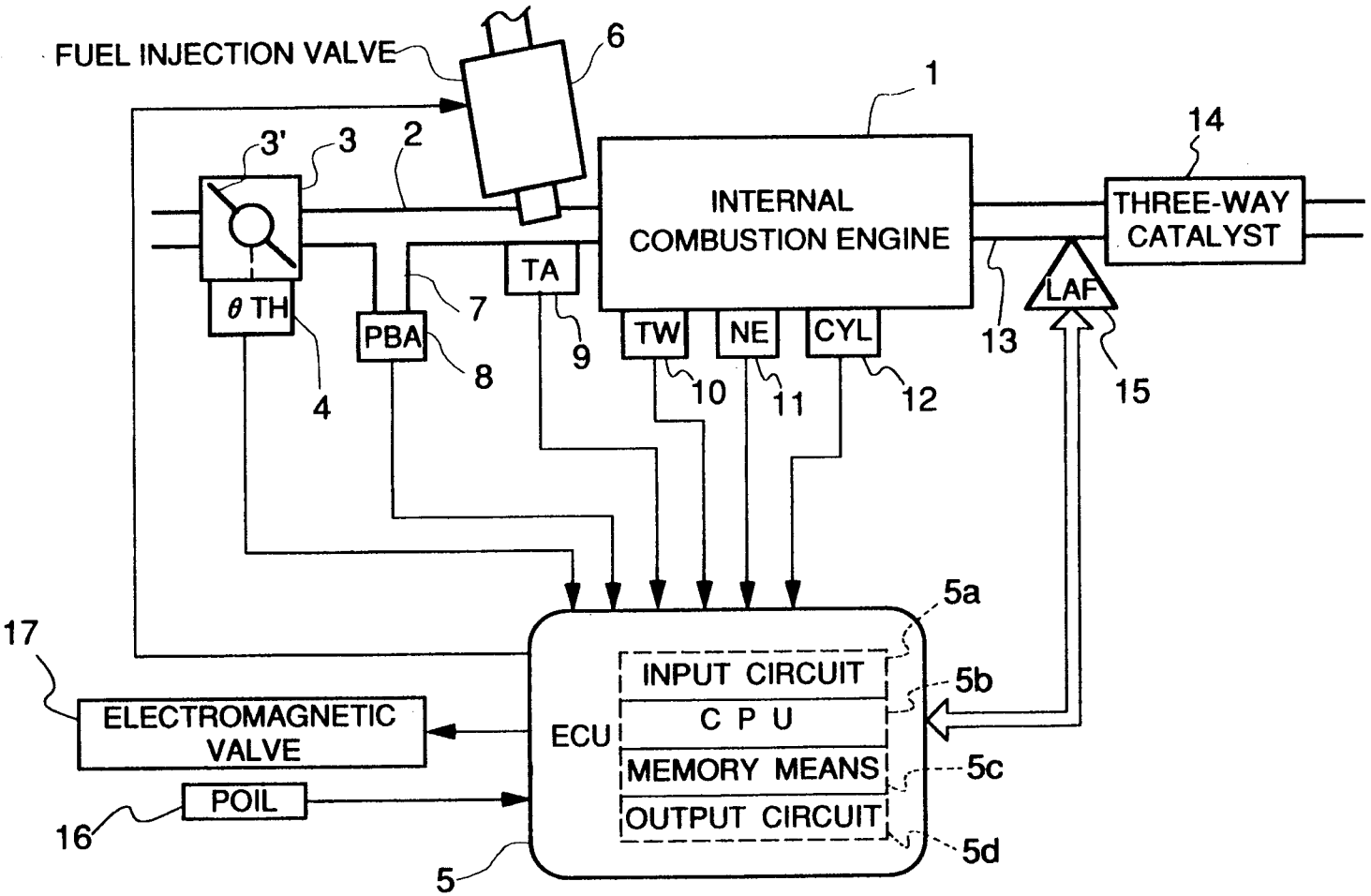
FIG. 1 is a block diagram of the whole arrangement of a fuel supply control system for an internal combustion engine, to which methods according to the invention are applied.

Referring first to FIG. 1, there is shown the whole arrangement of a fuel supply control system which is adapted to carry out the methods of this invention. In the figure, reference numeral 1 designates a DOHC straight type four cylinder internal combustion engine, each cylinder being provided with a pair of intake valves and a pair of exhaust valves, not shown. This engine 1 is arranged such that the operating characteristics of the intake valves and exhaust valves (more specifically, the valve opening period and the lift (generically referred to hereinafter as "valve timing") permit selection between a high speed valve timing adapted to a high engine speed region and a low speed valve timing adapted to a low engine speed region.

In an intake pipe 2 of the engine 1, there is arranged a throttle body 3 accommodating a throttle valve 3' therein. A throttle valve opening ($\theta$TH) sensor 4 is connected to the throttle valve 3' for generating an electric signal indicative of the sensed throttle valve opening and supplying same to an electronic control unit (hereinafter referred to as "the ECU") 5.

Fuel injection valves 6 are each provided for each cylinder and arranged in the intake pipe 2 between the engine 1 and the throttle valve 3', and at a location slightly upstream of the intake valves. The fuel injection valves 6 are connected to a fuel pump, not shown, and electrically connected to the ECU 5 to have their valve opening periods controlled by signals therefrom.

An electromagnetic valve 17 is connected to the output side of the ECU 5 to selectively control the aforementioned valve timing, the opening and closing of this electromagnetic valve 17 being controlled by the ECU 5. The valve 17 selects either high or low hydraulic pressure applied to a valve timing selection mechanism, not shown. Corresponding to this high or low hydraulic pressure, the valve timing is thereby adjusted to either a high speed valve timing or a low speed valve timing. The hydraulic pressure applied to this selection mechanism is detected by a hydraulic pressure (oil pressure) (POIL) sensor 16 which supplies a signal indicative of the sensed hydraulic pressure to the ECU 5.

Further, an intake pipe absolute pressure ($P_{BA}$) sensor 8 is provided in communication with the interior of the intake pipe 2 via a conduit 7 at a location immediately downstream of the throttle valve 3' for supplying an electric signal indicative of the sensed absolute pressure to the ECU 5. An intake temperature ($T_A$) sensor 9 is inserted into the intake pipe 2 at a location downstream of the intake pipe absolute pressure sensor 8 for supplying an electric signal indicative of the sensed intake temperature $T_A$ to the ECU 5.

An engine coolant temperature ($T_W$) sensor 10, which may be formed of a thermistor or the like, is mounted in the cylinder block of the engine 1 for supplying an electric signal indicative of the sensed engine coolant temperature $T_W$ to the ECU 5. An engine rotational speed (NE) sensor 11 and a cylinder-discriminating (CYL) sensor 12 are arranged in facing relation to a camshaft or a crankshaft of the engine 1, neither of which is shown. The engine rotational speed sensor 11 generates a pulse as a TDC signal pulse at each of predetermined crank angles whenever the crankshaft rotates through 180 degrees, while the cylinder-discriminating sensor 12 generates a pulse at a predetermined crank angle of a particular cylinder of the engine, both of the pulses being supplied to the ECU 5.

A three-way catalyst 14 is arranged within an exhaust pipe 13 connected to the cylinder block of the engine 1 for purifying noxious componets such as HC, CO and $NO_X$. An $O_2$ sensor 15 as an exhaust gas ingredient concentration sensor (referred to hereinafter as an "LAF sensor") is mounted in the exhaust pipe 13 at a location upstream of the three-way catalyst 14, for supplying an electric signal having a level approximately proportional to the oxygen concentration in the exhaust gases to the ECU 5.

The ECU 5 comprises an input circuit 5*a* having the functions of shaping the waveforms of input signals from various sensors, shifting the voltage levels of sensor output signals to a predetermined level, converting analog signals from analog-output sensors to digital signals, and so forth, a central processing unit (hereinafter referred to as "the CPU") 5*b*, memory means 5*c* storing various operational programs which are executed in the CPU 5*b* and for storing results of calculations therefrom, etc., and an output circuit 5*d* which outputs driving signals to the fuel injection valves 6 and the electromagnetic valve 17.

The CPU 5*b* operates in response to the above-mentioned signals from the sensors to determine operating conditions in which the engine 1 is operating such as an air-fuel ratio feedback control region and open-loop control regions, and calculates, based upon the determined operating conditions, the valve opening period or fuel injection period $T_{OUT}$ over which the fuel injection valves 6 are to be opened by the use of the following equation (1) in synchronism with inputting of TDC signal pulses to the ECU 5:

$$T_{OUT} = T_i \times KCMDM \times KLAF \times K_1 + K_2 \quad (1)$$

where $T_i$ represents a basic fuel amount, more specifically a basic fuel injection period which is determined according to the engine rotational speed Ne and the intake pipe absolute pressure $P_{BA}$. The value of $T_i$ is determined by a $T_i$ map stored in the memory means 5*c*.

KCMDM is a modified desired air-fuel ratio coefficient which is set by means of a program shown in FIG. 2, described hereinafter, according to engine operating conditions, and calculated by multiplying a desired air-fuel ratio coefficient KCMD representing a desired air-fuel ratio by a fuel cooling correction coefficient KETV. The correction coefficient KETV is intended to apply a prior correction to the fuel injection amount in view of the fact that the supply air-fuel ratio varies due to the cooling effect produced when fuel is actually injected, and its value is set according to the value of the desired air-fuel ratio coefficient KCMD. Further, as will be clear from the aforementioned equation (1), the fuel injection period $T_{OUT}$ increases if the desired fuel-air injection ratio coefficient KCMD increases, so that the values of KCMD and KCMDM will be in direct proportion to the reciprocal of the air-fuel ratio A/F.

KLAF is an air-fuel ratio correction coefficient which is set such that the air-fuel ratio detected by the LAF sensor 15 during air-fuel ratio feedback control coincides with the desired air-fuel ratio, and is set to predetermined values or average values (learned values) KREFi thereof depending on engine operating conditions during open-loop control.

$K_1$ and $K_2$ are other correction coefficients and correction variables, respectively, which are calculated based on various engine parameter signals to such values as to optimize characteristics of the engine such as fuel consumption and accelerability depending on engine operating conditions.

The CPU 5*b* outputs a valve timing selection command signal depending on engine operating conditions, which causes opening and closing of the electromagnetic valve 17.

The CPU 5*b* performs calculations as described hereintofore, and supplies the fuel injection valves 6 and electromagnetic valve 17 with driving signals based on the calculation results through the output circuit 5*d*.

Figure 2:
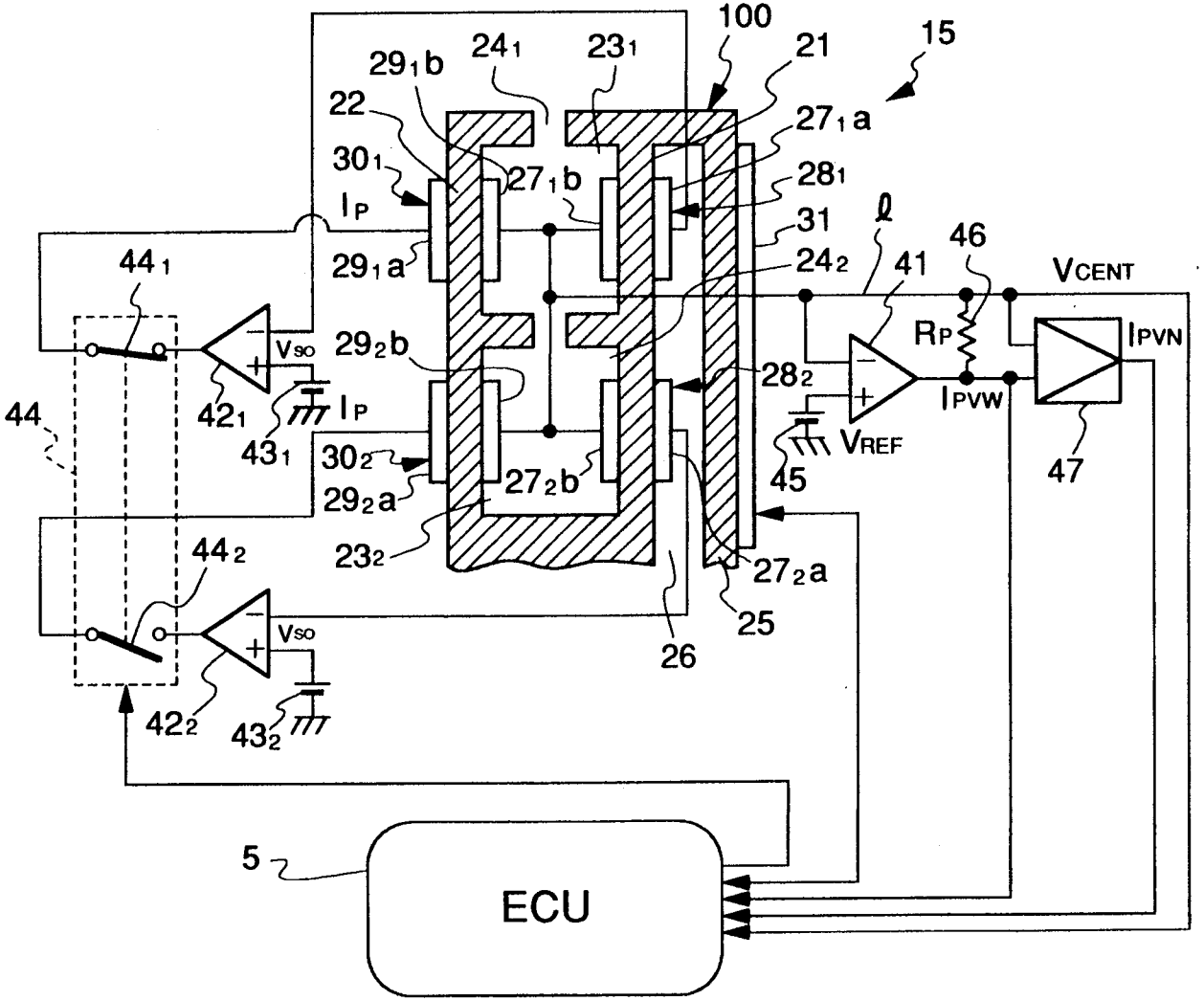
FIG. 2 is a schematic view showing the construction of an oxygen concentration sensor as the exhaust gas ingredient concentration sensor.

Referring next to FIG. 2, there is illustrated the construction of the LAF sensor 15 and its associated components.

In the figure, reference numeral 100 designates a body (sensor element section) of the LAF sensor 15. The sensor body 100 is arranged within the exhaust pipe 13.

Figure 3:
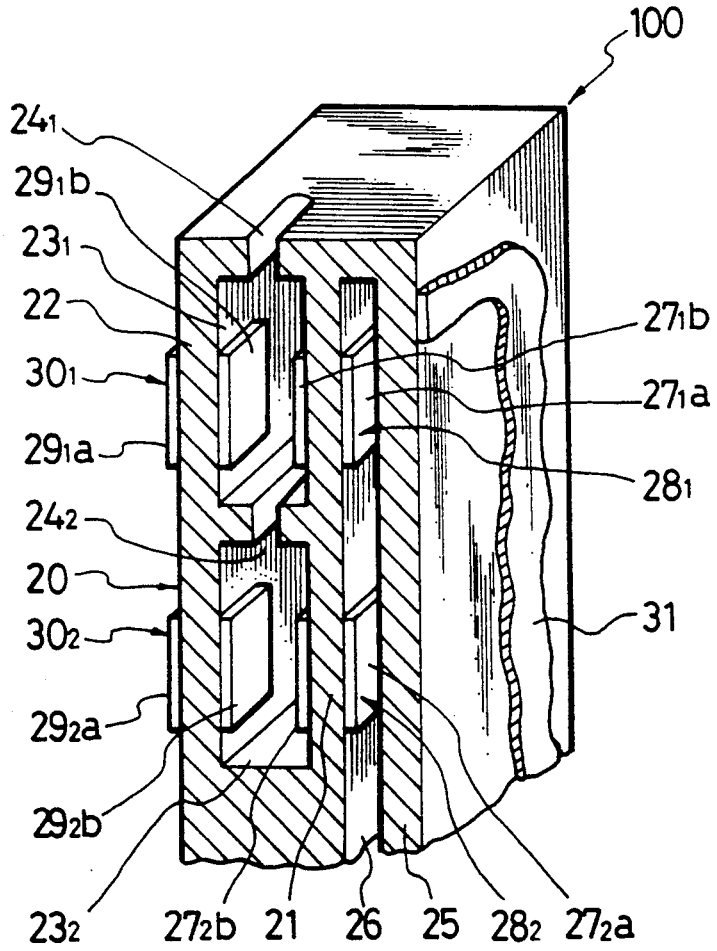
FIG. 3 is a perspective view, partly broken away, of the same sensor.

As shown in detail in FIG. 3, the sensor body 100 is in the form of a rectangular parallelepiped, and comprises a basic body 20 formed of a solid electrolytic material having oxygen ion-conductivity (e.g. zirconium dioxide ($Zro_2$)).

The sensor body 100 shown in the figures is a type which has two oxygen concentration sensor elements longitudinally arranged, each having a cell element and an oxygen pumping element. The basic body 20 of the sensor body 100 has first and second walls 21, 22 extending parallel with each other, between which first and second gas diffusion chambers (diffusion restriction regions) $23_1$, $23_2$ serving as gas diffusion-limiting zones are defined.

The first gas diffusion chamber $23_1$ is communicated with an exhaust pipe, not shown, of the engine through a first slit $24_1$ which is disposed such that exhaust gases in the exhaust pipe can be guided into the first gas diffusion chamber $23_1$ through the slit $24_1$. The exhaust gases within the first gas diffusion chamber $23_1$ is introduced into the second gas diffusion chamber $23_2$ through a second slit $24_2$ communicating between the two chambers $23_1$ and $23_2$. An air reference chamber 26 to be supplied with air or reference gas is defined between the first wall 21 and an outer wall 25 disposed adjacent the first wall 21 and extending parallel therewith.

In order to detect oxygen concentration within the first gas diffusion chamber $23_1$, a first couple of electrodes $27_1$a, $27_1$b formed of platinum (Pt) are mounted on opposite side surfaces of the first wall 21, which cooperate with the first wall 21 to form a cell element (sensing cell) $28_1$ for the first oxygen concentration sensor element, while a second couple of electrodes $29_1$a, $29_1$b are similarly mounted on opposite side surfaces of the second wall 22, which cooperate with the second wall 22 to form an oxygen-pumping element (pumping cell) $30_1$ for the first oxygen concentration sensor element.

On the other hand, in order to detect oxygen concentration within the second gas diffusion chamber $23_2$, a cell element $28_2$ for the second oxygen concentration sensor element having a first couple of electrodes $27_2$a, $27_2$b, and an oxygen-pumping element $30_2$ for the second oxygen concentration sensor element having a second couple of electrodes $29_2$a, $29_2$b are respectively mounted on the first and second walls 21, 22, similarly to the cell element $28_1$ and the oxygen-pumping element $30_1$.

A heater (heating element) 31 is provided on an outer side surface of the outer wall 25, for heating the cell elements $28_1$, $28_2$ and the oxygen-pumping elements $30_1$, $30_2$ to activate them.

As shown in FIG. 2, the electrodes $27_1$b and $29_1$b for the first oxygen concentration sensor element, which are located on the first gas diffusion chamber $23_1$ side, are connected with each other (in the embodiment of FIG. 2, they are connected by a suitable electrically conductive member 32), and are connected to an inverting input terminal of an operational amplifier 41 through a line 1.

On the other hand, the other electrode $27_1$a of the cell element $28_1$ for the first oxygen concentration sensor element is connected to an inverting input terminal of a differential amplifier circuit $42_1$ for the first oxygen concentration sensor element. The differential amplifier circuit $42_1$ forms a voltage-applying circuit (voltage-applying means) together with a reference voltage source $43_1$ connected to a non-inverting input terminal thereof for applying to the oxygen-pumping element $30_1$ a voltage corresponding to the difference between a voltage (cell element voltage) developed between the electrodes $27_1$a and $27_1$b of the cell element $28_1$ (in the FIG. 2 embodiment, the sum of a voltage on the line 1 and the cell element voltage) and a reference voltage Vso from the reference voltage source $43_1$.

In the present embodiment, the reference voltage Vso of the reference voltage source $43_1$ is normally set to a value of the sum of the cell element voltage developed across the cell element $28_1$ when the actual air-fuel ratio of a mixture supplied to the engine is equal to a stoichiometric mixture ratio, e.g. 0.45 volts and a predetermined reference voltage, hereinafter referred to, applied to a non-inverting input terminal of the operational amplifier 41. However, the reference voltage Vso can be changed temporarily to a value, e.g., 3.05 V, higher by a predetermined value than the above normal value, when the output of the $O_2$ sensor has its value corrected for deterioration of the $O_2$ sensor 1.

The differential amplifier circuit $42_1$ has an output terminal thereof connected to the electrode $29_1$a of the oxygen-pumping element $30_1$ remote from the first gas diffusion chamber $23_1$ by way of a switch $44_1$ of a switching circuit 44. The switching circuit 44 is controlled to close or open in dependence on activation and non-activation of the sensor body 100 as well as on operating conditions of the engine. More specifically, when the sensor body 100 is inactivated, both of the switches $44_1$ and $44_2$ are opened, and on the other hand, when it is activated, one of the switches is closed in response to operating conditions of the engine.

When the switch $44_1$ is closed, the voltage applied to the outer electrode $29_1$a of the oxygen pumping element $30_1$ changes as the output from the differential amplifier circuit $42_1$ changes into a positive level or a negative level in response to whether the supply air-fuel ratio changes to a lean side or a rich side with respect to the stoichiometric air-fuel ratio. Further, responsive to the change of the output from the differential amplifier circuit $42_1$, there occurs a change in the direction (positive or negative) of pumping current Ip flowing to a pumping current detecting resistance 46, hereinafter referred to, through the oxygen pumping element $30_1$ and the line 1.

The non-inverting input terminal of the operational amplifier circuit 41 is connected to a reference voltage source 45 to be supplied with the predetermined reference voltage therefrom. The current-detecting resistance 46 for detecting pumping current Ip is connected between an output terminal of the operational amplifier circuit 41 and the line 1 or an inverting input terminal of the operational amplifier circuit 41.

The second oxygen concentration sensor element of the sensor body 100 has a similar construction to the first oxygen concentration sensor element. That is, in the voltage-applying circuit and the switching circuit 44, there are respectively provided a differential amplifier circuit $42_2$, a reference voltage source $43_2$, and the aforementioned switch $44_2$. The switch $44_2$ is connected to the outer side electrode $29_2$a of the oxygen-pumping element $30_2$, and the respective inner side electrodes $27_2$b and $29_2$b of the cell element $28_2$ and the oxygen-pumping element $30_2$ are both connected to the line 1, so that, during the use of the second oxygen concentration sensor element, the pumping current Ip flowing through the oxygen-pumping element $30_2$ flows in the line 1.

The output voltage $I_{PVW}$ of the operational amplifier circuit 41 and the voltage $V_{CENT}$ on the line 1, at the opposite ends of the current-detecting resistance 46, are supplied to an input port 401 of an electronic control unit (hereinafter called "the ECU") 4 as voltage-detecting means and are at the same time supplied to respective inputs of a differential amplifier circuit 47.

The differential amplifier circuit 47 amplifies the difference between the voltage $V_{CENT}$ and the output voltage $I_{PVW}$ of the operational amplifier circuit 41, and thus serves to improve the accuracy of a signal indicative of a voltage detected from pumping current Ip which assumes 0 or a value close thereto, i.e. where the actual air-fuel ratio is within a predetermined range about the stoichiometric air-fuel ratio of the mixture. In the differential amplifier circuit 47, the $I_{PVW}$ signal is amplified by a predetermined magnification $\alpha$, e.g. 5 times, to be produced as a voltage $I_{PVN}$.

The output voltage $I_{PVN}$ of the differential amplifier circuit 47 is obtained by the following equation, and is also supplied to the ECU5:

$$I_{PVN} = -5(I_{PVW} - V_{CENT}) + V_{CENT} \quad (1)$$

The oxygen concentration is detected by the LAF sensor 15 in the following manner:

First, as shown in FIG. 2, exhaust gases are introduced into the first gas diffusion chamber $23_1$ through the first slit $24_1$ with operation of the engine. This causes a difference in oxygen concentration between the first gas diffusion chamber $23_1$ and the air reference chamber 26 into which air is introduced. Consequently, a voltage corresponding to the difference is developed between the electrodes $27_1a$ and $27_1b$ of the cell element $28_1$, which is added to the line 1 voltage $V_{CENT}$ and the same is applied to the inverting input terminal of the differential amplifier circuit $42_1$. As stated before, the reference voltage Vso supplied to the non-inverting input terminal of the differential amplifier circuit $42_1$ is set at the sum of a voltage developed across the cell element $28_1$ when the supply air-fuel ratio is equal to the stoichiometric air-fuel ratio, and the reference voltage $V_{REF}$ supplied to the operational amplifier circuit 41.

Therefore, when the supply air-fuel ratio is on the lean side, the voltage between the electrodes $27_1a$ and $27_1b$ of the cell element $28_1$ lowers, while the line l voltage $V_{CENT}$ is maintained at the reference voltage $V_{REF}$, so that the sum of the voltage between the electrodes $27_1a$ and $27_1b$ and the voltage $V_{CENT}$ becomes lower than the reference voltage Vso. Thus, the output level of the differential amplifier circuit $42_1$ becomes positive, and the positive level voltage is applied to the oxygen-pumping element $30_1$ via the switch $44_1$. By applying the positive level voltage, when the oxygen-pumping element $30_1$ is activated, oxygen present within the gas diffusion chamber $23_1$ is ionized, whereby the resulting ions move through the electrode $29_1b$, the second wall 22, and electrode $29_1a$ to be emitted therefrom as oxygen gas or pumped out of the $O_2$ sensor 1. Then, the pumping current Ip flows from the electrode $29_1a$ to the electrode $29_1b$ and flows through the current-detecting resistance 46 via the line l. At this time, the pumping current Ip flows from the line l to the output side of the operational amplifier circuit 41.

On the other hand, when the air-fuel ratio is on the rich side, the sum of the voltage between the electrodes $27_1a$ and $27_1b$ of the cell element $28_1$ and the line l voltage $V_{CENT}$ becomes higher than the reference voltage Vso, so that the output level of the differential amplifier circuit $42_1$ becomes negative. Consequently, reversely to the above described action, external oxygen is pumped into the gas diffusion chamber $23_1$ through the oxygen-pumping element $30_1$, and simultaneously the pumping current Ip flows from the electrode $29_1b$ to the electrode $29_1a$ and flows through the current-detecting resistance 46, that is, in the direction of flow of the pumping current Ip reverse to that in the above case.

When the actual air-fuel ratio is equal to the stoichiometric air-fuel ratio, the sum of the voltage between the electrodes $27_1a$ and $27_1b$ of the cell element $28_1$ and the line l voltage $V_{CENT}$ becomes equal to the reference voltage Vso, so that the pumping-in and -out of oxygen is not effected, whereby no pumping current flows (that is, the pumping current Ip is zero).

As described above, since the pumping-in and -out of oxygen and hence the pumping current Ip are controlled so as to maintain the oxygen concentration in the gas diffusion chamber $23_1$ at a constant level, the pumping current Ip assumes a value proportional to the oxygen concentration of the exhaust gases on both the lean and rich sides of the actual air-fuel ratio.

Signals for detecting the amount of the pumping current Ip flowing through the current-detecting resistance 46, e.g. signals indicative of respective voltages $I_{PVW}$, $V_{CENT}$, $I_{PVN}$ at the opposite ends of the resistance 46 are supplied to the ECU 5.

Similarly to the first oxygen concentration sensor element, when the second oxygen concentration sensor element is used (that is, when the switch $44_2$ of the switching circuit 44 is closed, as reversely to the position shown in FIG. 2), the pumping-in and -out of oxygen is controlled so as to maintain the oxygen concentration in the second gas diffusion chamber $23_2$ at a constant value, that is, the voltage between the electrodes $27_2a$ and $27_2b$ of the cell element $28_2$ is feedback-controlled to be maintained at a constant value, and at the same time the signals indicative of the voltages $I_{PVW}$, $V_{CENT}$, $I_{PVN}$ for detecting the pumping current Ip flowing during the feedback control are supplied to the ECU 5 as outputs of the second oxygen concentration sensor element.

Figure 4:
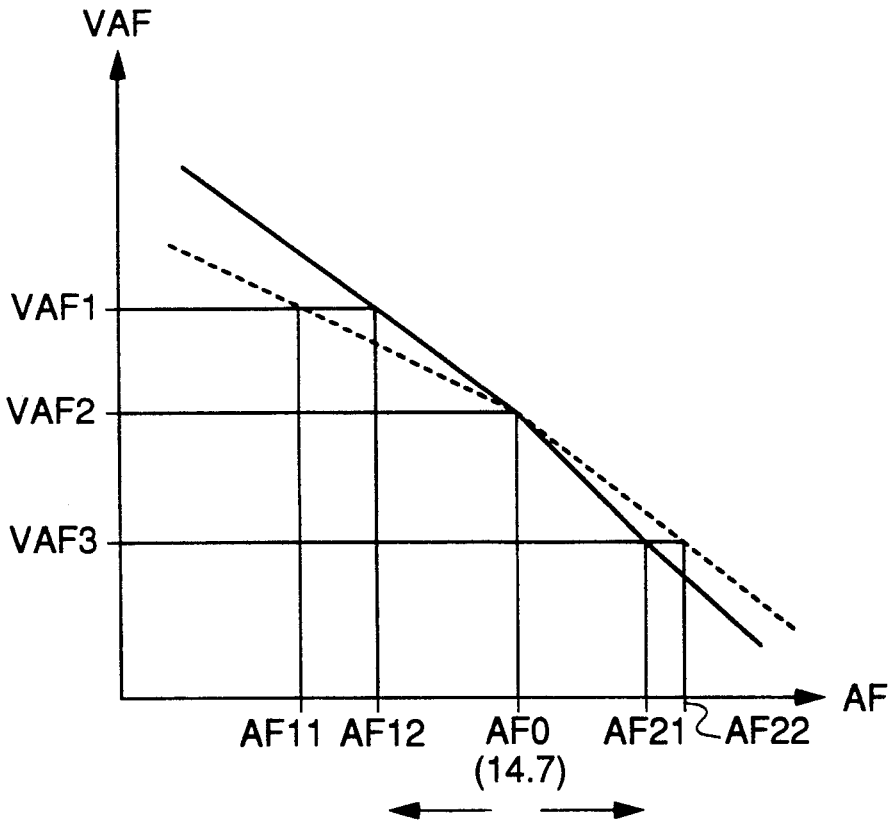
FIG. 4 is a graph showing the relationship between the air-fuel ratio (A/F) and the output value (VAF) of the oxygen concentration sensor.

FIG. 4 shows output characteristics of the LAF sensor 15. When the sensor is normally functioning, its output characteristic varies along the solid line in the figure, while when it is deteriorated, its output characteristic varies along the broken line in the figure. More specifically, when the air-fuel ratio is on the lean side with respect of the stoichiometric air-fuel ratio, the sensor output value (a value obtained by analog-to-digital conversion of the voltage $I_{PVW}$ or $I_{PVN}$) VAF is deviated toward an increased value, while when the air-fuel ratio is on the rich side, the output value VAF is deviated toward a decreased value. However, when the air-fuel ratio is equal to or in the vicinity of the stoichiometric air-fuel ratio, there is almost no deviation in the output value VAF. Therefore, when the LAF sensor is deteriorated, if the sensor output VAF assumes a value VAF1 on the rich side with respect to the stoichiometric air-fuel ratio, for example, an air-fuel ratio AF12 (A/F=12) is detected though the actual air-fuel ratio is 11 (=AF11), that is, an air-fuel ratio value is detected which is deviated toward the lean side with respect to the stoichiometric air-fuel ratio. Further, when the LAF sensor output assumes a value VAF2, an air-fuel ratio AF21 (A/F=21) is detected which is deviated toward the rich side, though the actual air-fuel ratio is 22 (=AF22).

When the LAF sensor output assumes a value AFO which is equal to the stoichiometric air-fuel ratio, there occurs no deviation in the detected air-fuel ratio.

If the air-fuel ratio correction coefficient KLAF is calculated based upon these detected sensor output values VAF0, VAF1, and VAF2, it presents calculated values as follows:

(i) When VAF=VAF0, there is no deviation in the calculated KLAF value;

(ii) When VAF=VAF1, the calculated KLAF value is deviated to an increased value; and (iii) When VAF=VAF2, the calculated KLAF value is deviated to a decreased value.

Therefore, according to the invention, in each of engine operating regions corresponding respectively to the above cases (i)-(iii), a learned value KREF which is an average value of the KLAF value is calculated. Since the calculated learned value KREF varies in the same manner as the KLA value, the following relationships hold if the LAF sensor is deteriorated;

$$KREF2L1/KREF2LO < 1.0 \ldots \quad (2)$$

$$KREF2L2/KREF2LO > 1.0 \ldots \quad (3)$$

where KREF2LO−2 represent average values of the KLAF value calculated respectively in the engine operating regions corresponding respectively to the cases (i)-(iii).

Incidentally, variations in the KLAF value due to other factors than the deterioration of the LAF sensor are identical between when the sensor output assumes a rich value and when it assumes a lean value in any of the cases (i)-(iii). Accordingly, KREF2LO ≈KREF2L1≈KREF2L2 so that the above relationships (2) and (3) do not hold.

Therefore, when the two relationships (2), (3) both hold at the same time, it can be judged that the LAF sensor 15 is deteriorated. If determination parameter values KL, KR are provided as follows:

KL=KREF2L1/KREF2LO

KR=KREF2L2/KREF2LO, the degree of deterioration of the LAF sensor can be determined from the values KL, KR.

Figure 5:
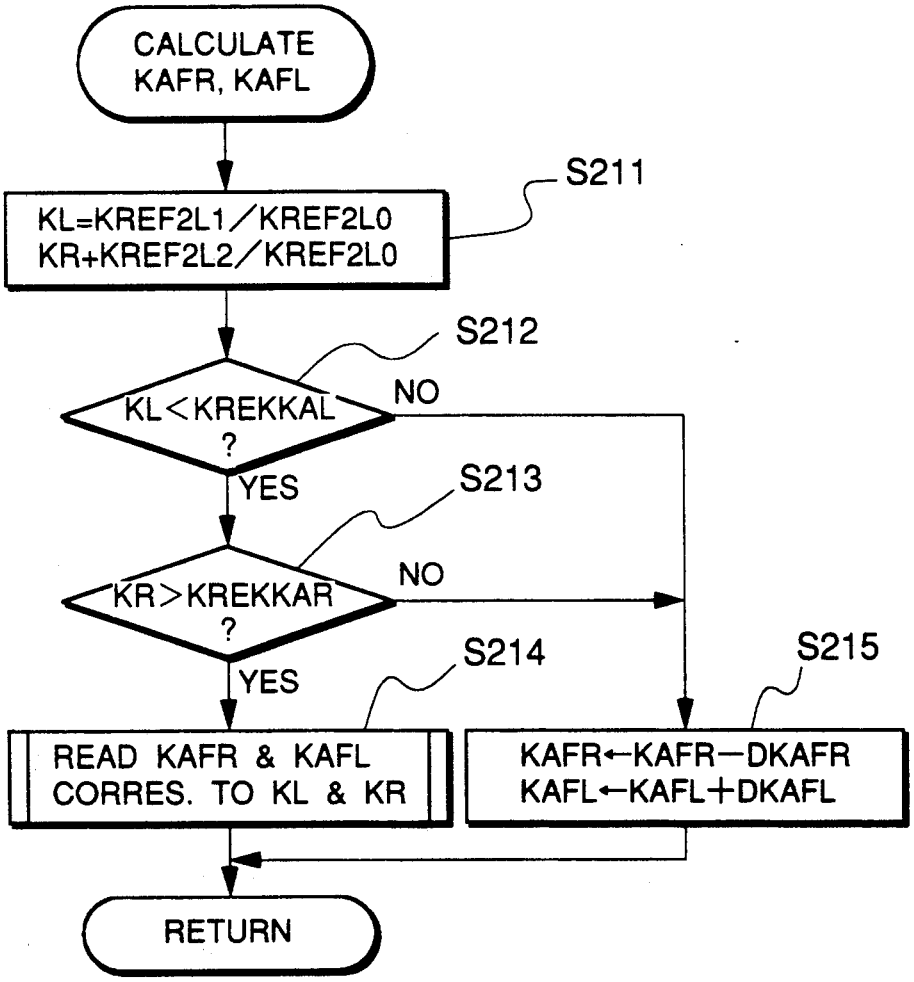
FIG. 5 is a flowchart of a program for calculating sensor output correction coefficients (KAFR, KAFL) for correcting the output from the oxygen concentration sensor.

FIG. 5 shows a program for determining the degree of deterioration of the LAF sensor by the use of the above-mentioned deterioration detecting manner, and calculating sensor output correction coefficients KAFR, KAFL for correcting the LAF sensor output VAF based upon the determined degree of deterioration. The coefficient KAFR is a correction coefficient which is applied when the air-fuel ratio on the rich side with respect to the stoichiometric air-fuel ratio, and KAFL is a correction coefficient applied when the air-fuel ratio is on the lean side.

In FIG. 5, first, at a step S211, the determination parameter values KL, RR are calculated to determine the degree of deterioration, and it is determined whether the lean-side parameter value KL is smaller than a lean-side determination value KREKKAL (e.g. 0.8), at a step S212. If KL<KREKKAL, then it is determined whether the rich-side parameter value KR is larger than a rich-side determination value KREKKAR (e.g. 1.2), at a step S213.

Figure 6A:
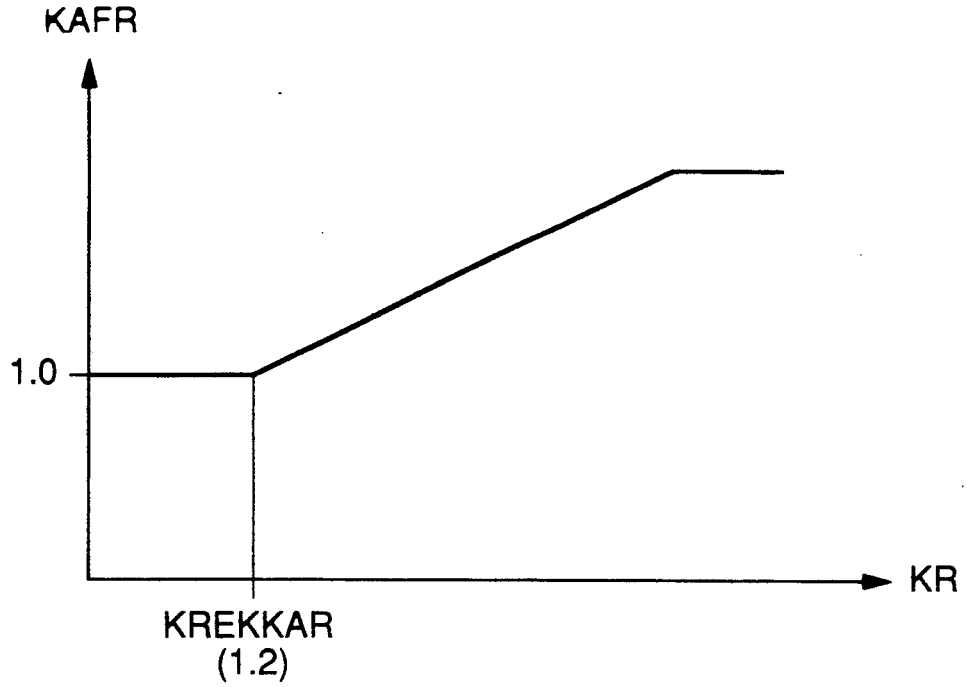
FIG. 6(*a*) is a view showing a table of the sensor output correction coefficient KAFR.
Figure 6B:
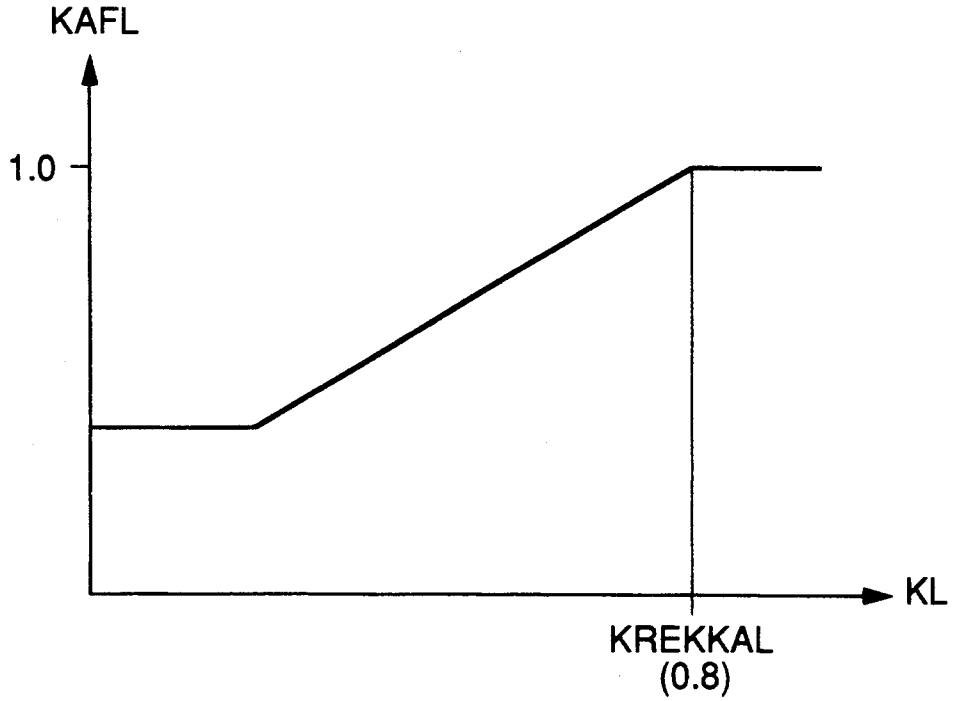

If both the answers to the questions of the steps S212, S213 are affirmative (YES), i.e. if KL<KREKKAL and KR>KREKKAR, it is judged that the LAF sensor is deteriorated, and then a table in FIG. 6 is retrieved to read the rich-side sensor output correction coefficient KAFR ((a) in FIG. 6) and the lean-side sensor output correction coefficient KAFL ((b) in FIG. 6) in accordance with the values KL, KR. According to the table of FIG. 6, the value RAFR is set to a value larger than 1.0 if KR>KREKKAR, and the value KAFL a value smaller than 1.0 if KL<KREKKAL.

If the answer to the question of the step S212 or S213 is negative (No), i.e. if KL≧KREKKAL or KR≦KREKKAR, the value KAFR is decreased by a predetermined amount DKAFR, and the value KAFL is increased by a predetermined amount DKAFL, at a step S215. That is, in the case where once KR>KREKKAR and KL<KREKKAL hold and then KR≦KREKKAR or KL≧KREKKAL again holds, for example, when the LAF sensor temporarily shows an deteriorated output characteristic due to deposition of carbon or the like on a portion of the sensor and then returns into a normal condition, the correction coefficients KAFL, KAFR should desirably be gradually or slowly returned to 1.0. The minimum value of KAFR and the maximum value of KAFL are both set at 1.0 (non-correction value), that is, in no case KAFR<1.0 or KAFL>1.0.

Figure 12:
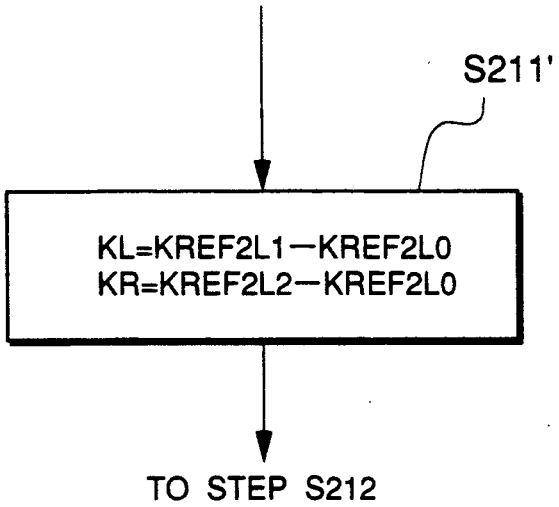
FIG. 12 is a part of a flowchart of a variation of the program of FIG. 5.

Instead of determining KL, KR from the ratios between the average values KREF2LO−2 as in the step S211, KL, KR may be determined by calculating differences between the average values as shown in a step S211' in FIG. 12.

Figure 7:
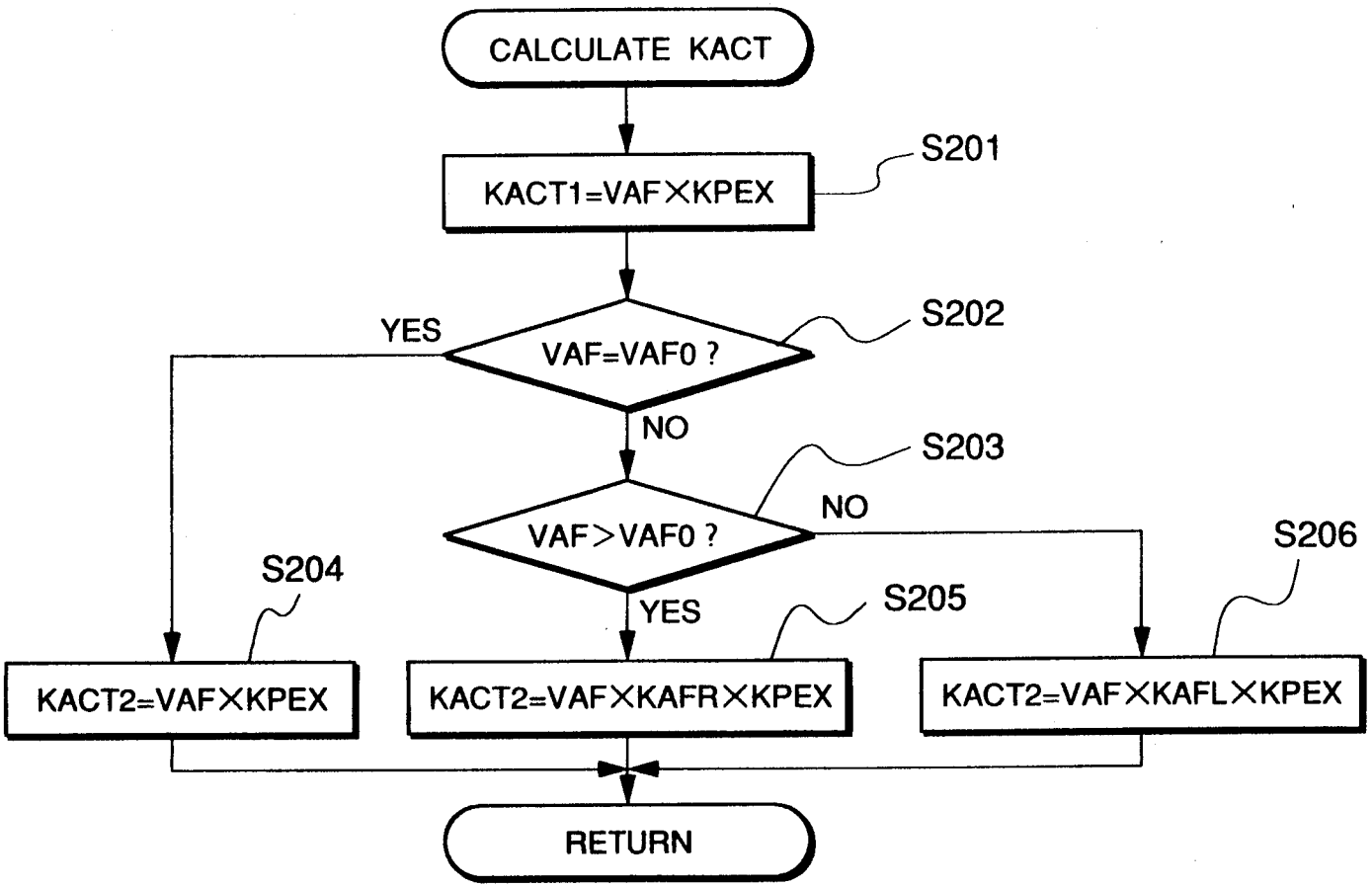
FIG. 7 is a flowchart of a program for calculating an equivalent ratio (KACT) from the sensor output value.

FIG. 7 shows a program for correcting the LAF sensor output value VAF by the use of the sensor output correction coefficients KAFR, KAFL calculated by the FIG. 5 program, and thereby calculating an equivalent ratio KACT indicative of the detected air-fuel ratio (hereinafter referred to as "detected air-fuel ratio).

First, at a step S201, the sensor output value VAF is multiplied by an exhaust pressure-dependent correction coefficient KPEX to thereby calculate a detected air-fuel ratio KACT1 before correction for deterioration. This exhaust pressure-dependent correction coefficient KPEX is intended to compensate for deviation of the detected air-fuel ratio due to variations in the exhaust pressure. Then, it is determined whether the sensor output value VAF is equal to a value VAO corresponding to the stoichiometric air-fuel ratio, at a step S202. If the answer is affirmative (YES), a detected air-fuel ratio KACT2 after correction for deterioration is also set to the same value (=VAF×KPEX) as the value KACT1, at a step S204. This is because, as shown in FIG. 4 referred to before, at the stoichiometric air-fuel ratio, the sensor output value VAF is not deviated even after deterioration of the LAF sensor.

If the answer to the question of the step S202 is negative (No), that is, VAF≠VAFO, it is determined whether the output value VAF is larger than the value VAFO, at a step S203. IF VAF>VAFO, which means that the air-fuel ratio is richer than the stoichiometric air-fuel ratio (the answer to the step S203 is affirmative or YES), the sensor output value VAF is multiplied by the exhaust pressure-dependent correction coefficient KPEX and the rich-side sensor output correction coefficient KAFR to calculate the detected air-fuel ratio KACT2 after deterioration correction, at a step S205.

On the other hand, if VAF<VAFO, that is, if the air-fuel ratio is leaner than the stoichiometric air-fuel ratio (the answer to the step S203 is negative or NO), the sensor output value VAF is multiplied by the exhaust pressure-dependent correction coefficient KPEX and the lean-side sensor output correction coefficient KAFL to calculate the detected air-fuel ratio KACT2 after deterioration correction, at a step S206.

Figure 8:
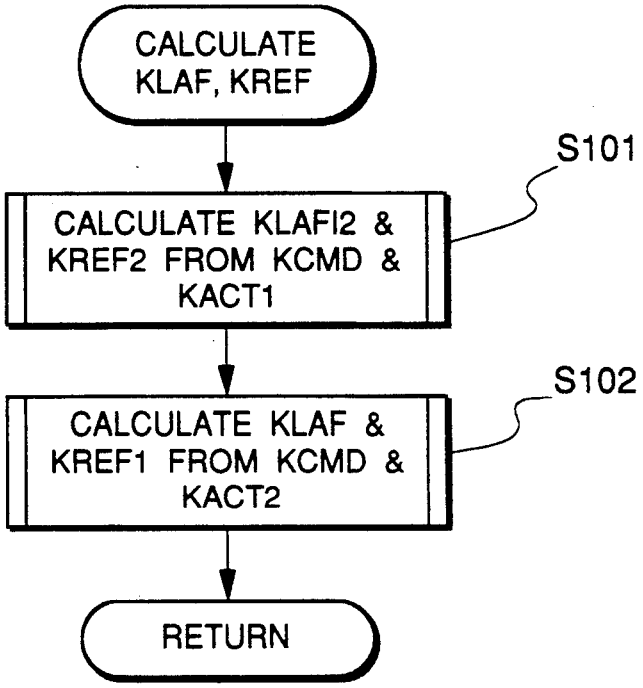
FIG. 8 is a flowchart of a whole program for calculating an air-fuel ratio correction coefficient (KLAF) and a learned value (KREF)
Figure 9A:
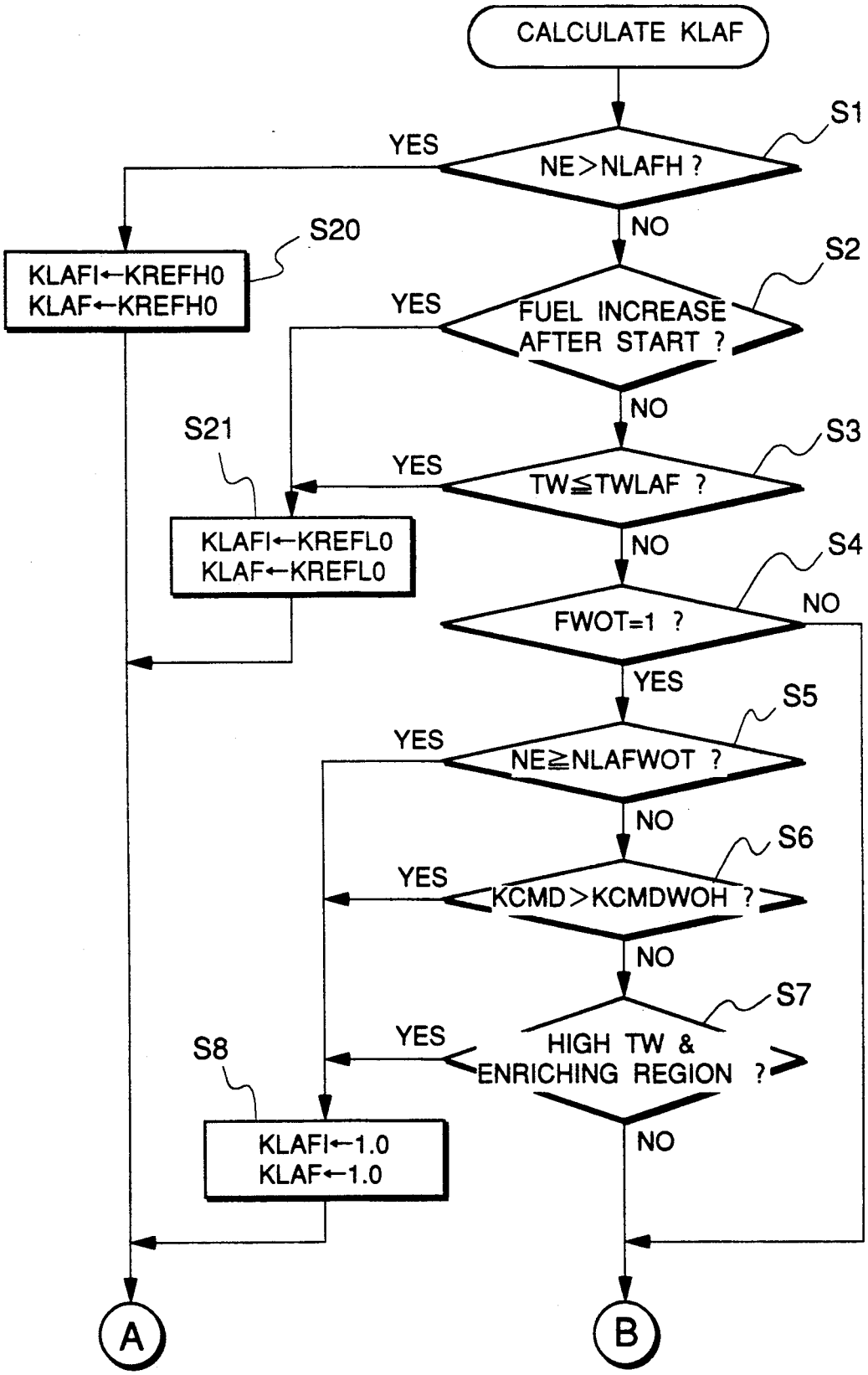
FIGS. 9*a* and 9*b* are a flowchart of a program for calculating the air-fuel ratio correction coefficient (KLAF)
Figure 9B:
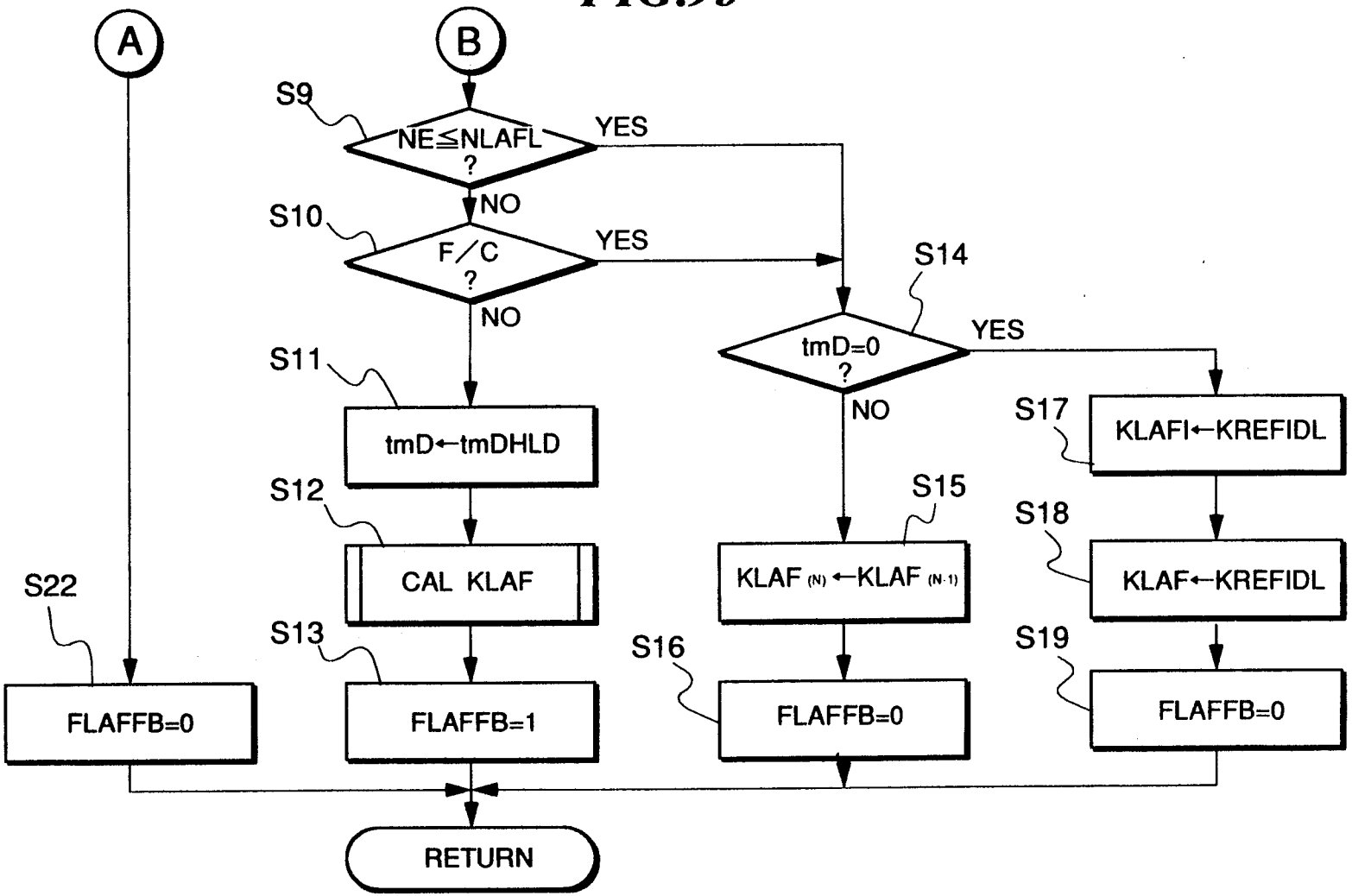
Figure 10A:
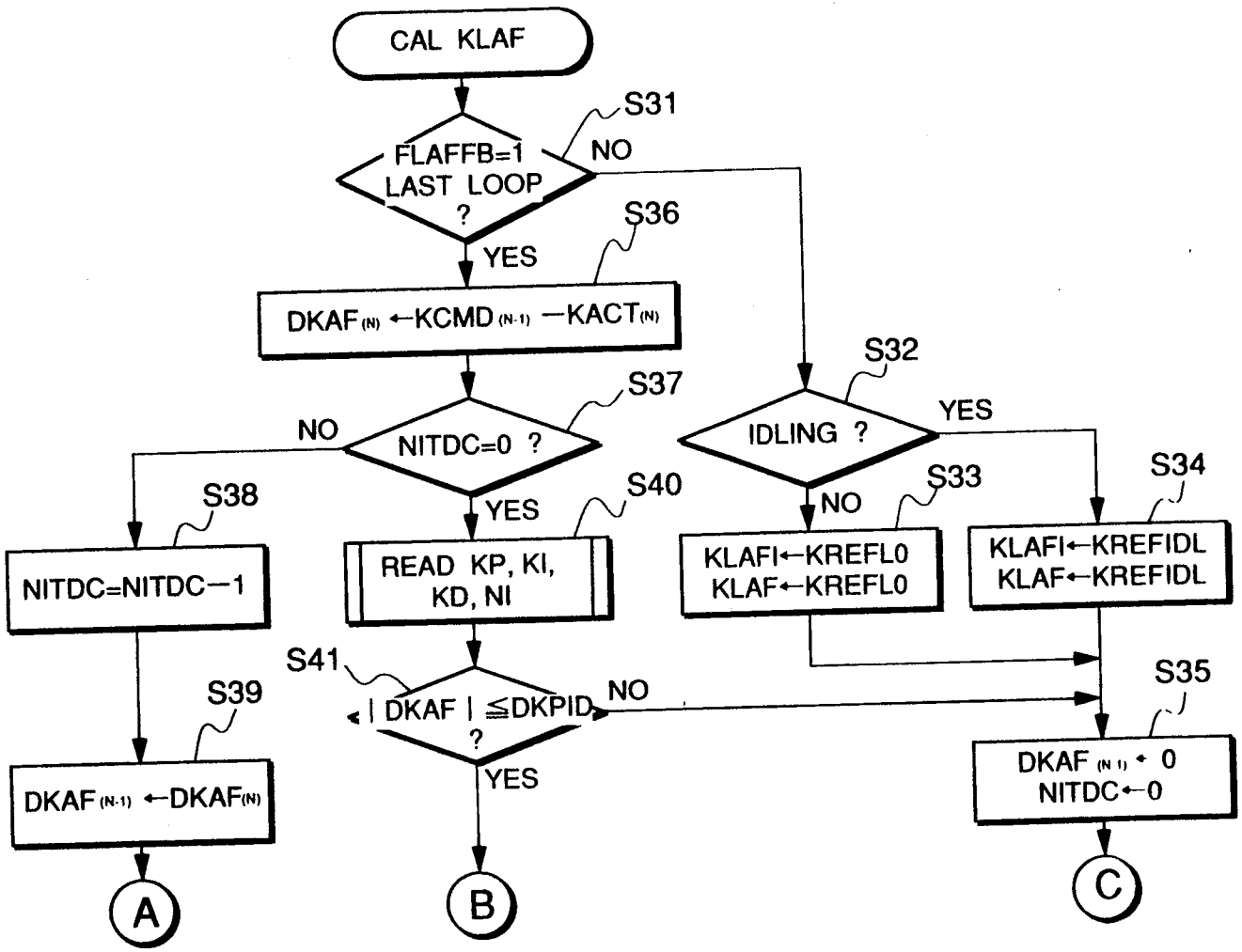
FIGS. 10*a* and 10*b* are flowchart of a program for calculating the air-fuel ratio correction coefficient based upon the output from the oxygen concentration sensor.
Figure 10B:
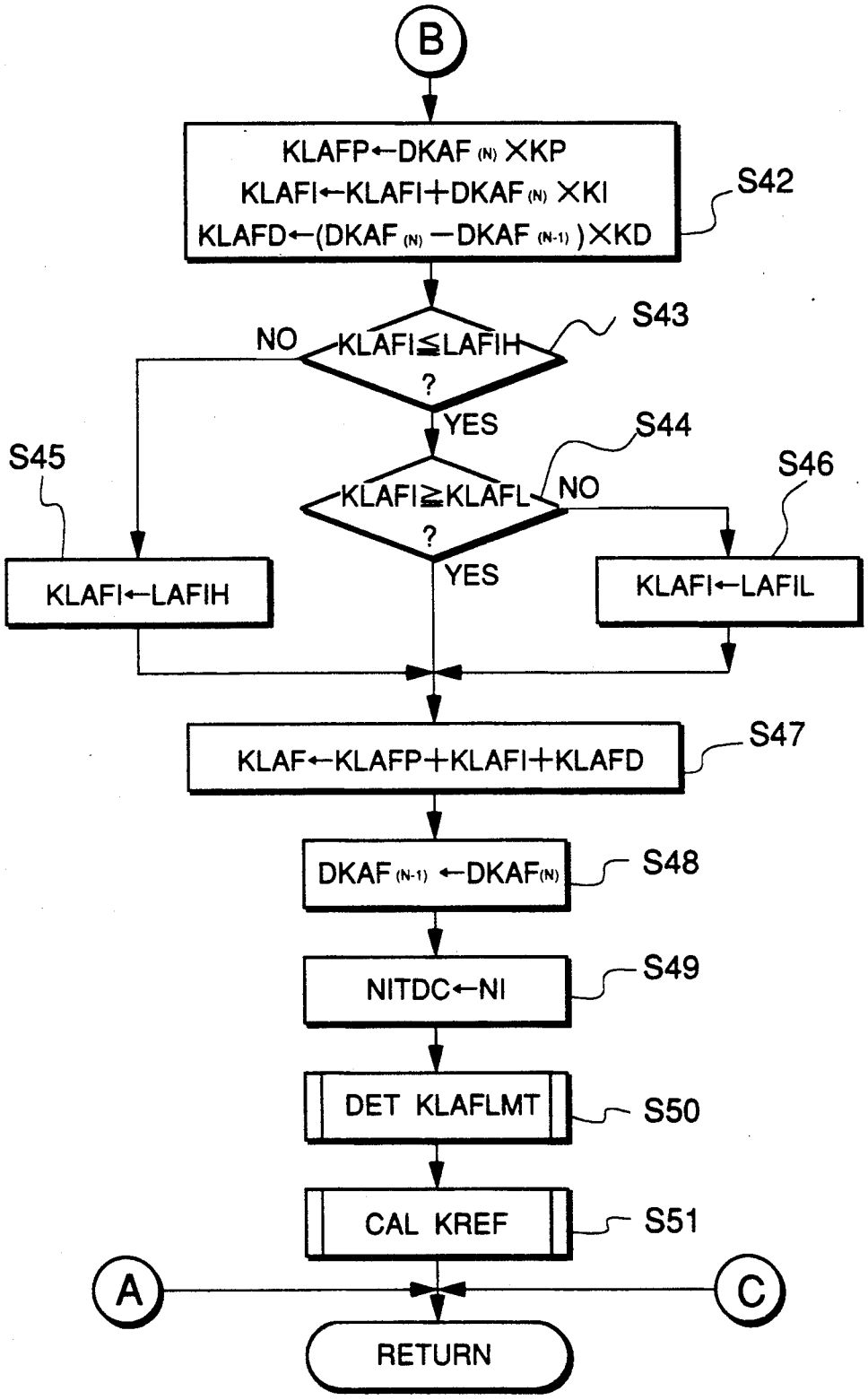
Figure 11A:
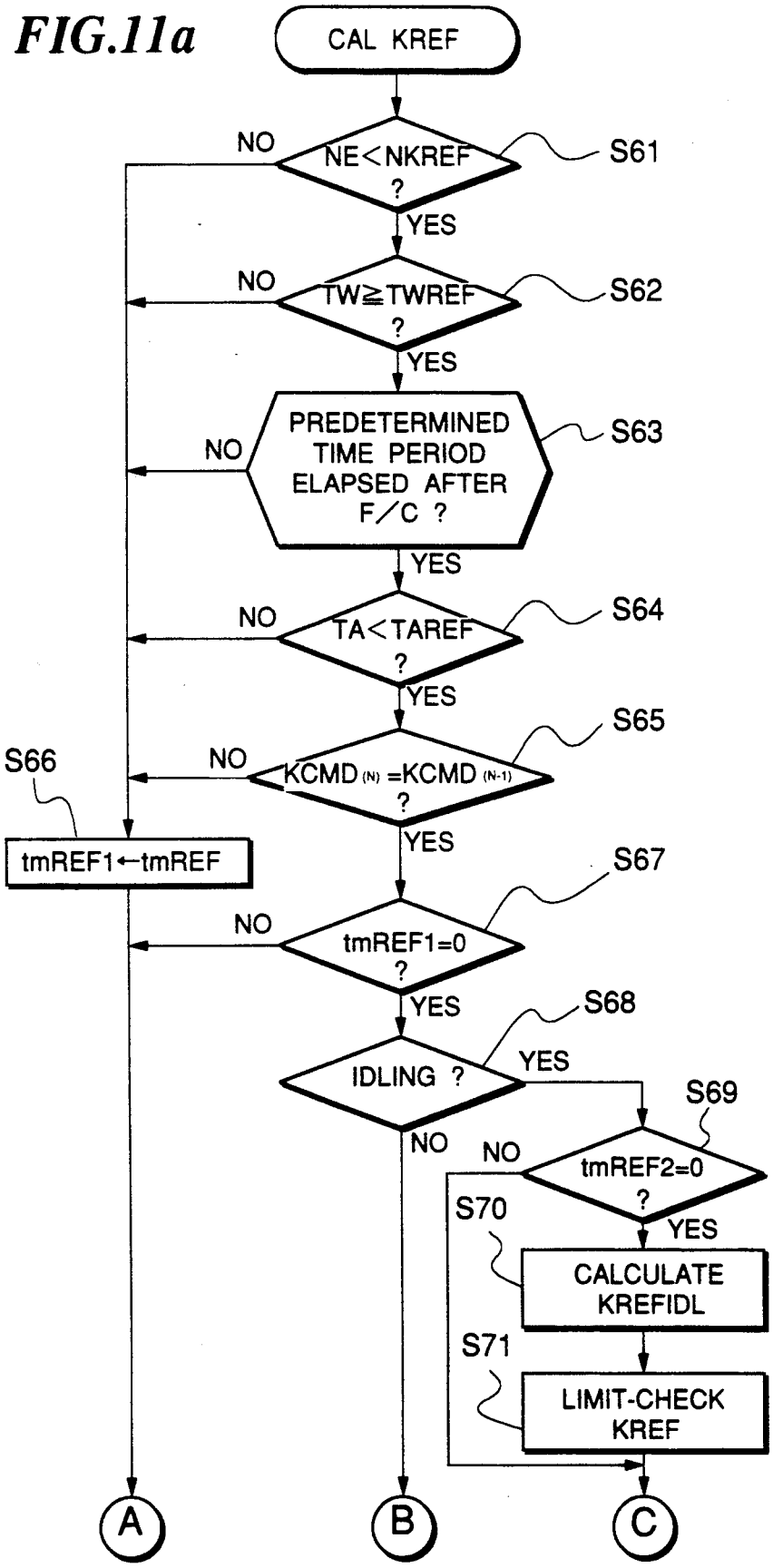
FIG. 11 is a flowchart of a program for calculating the learned value (KREF)
Figure 11B:
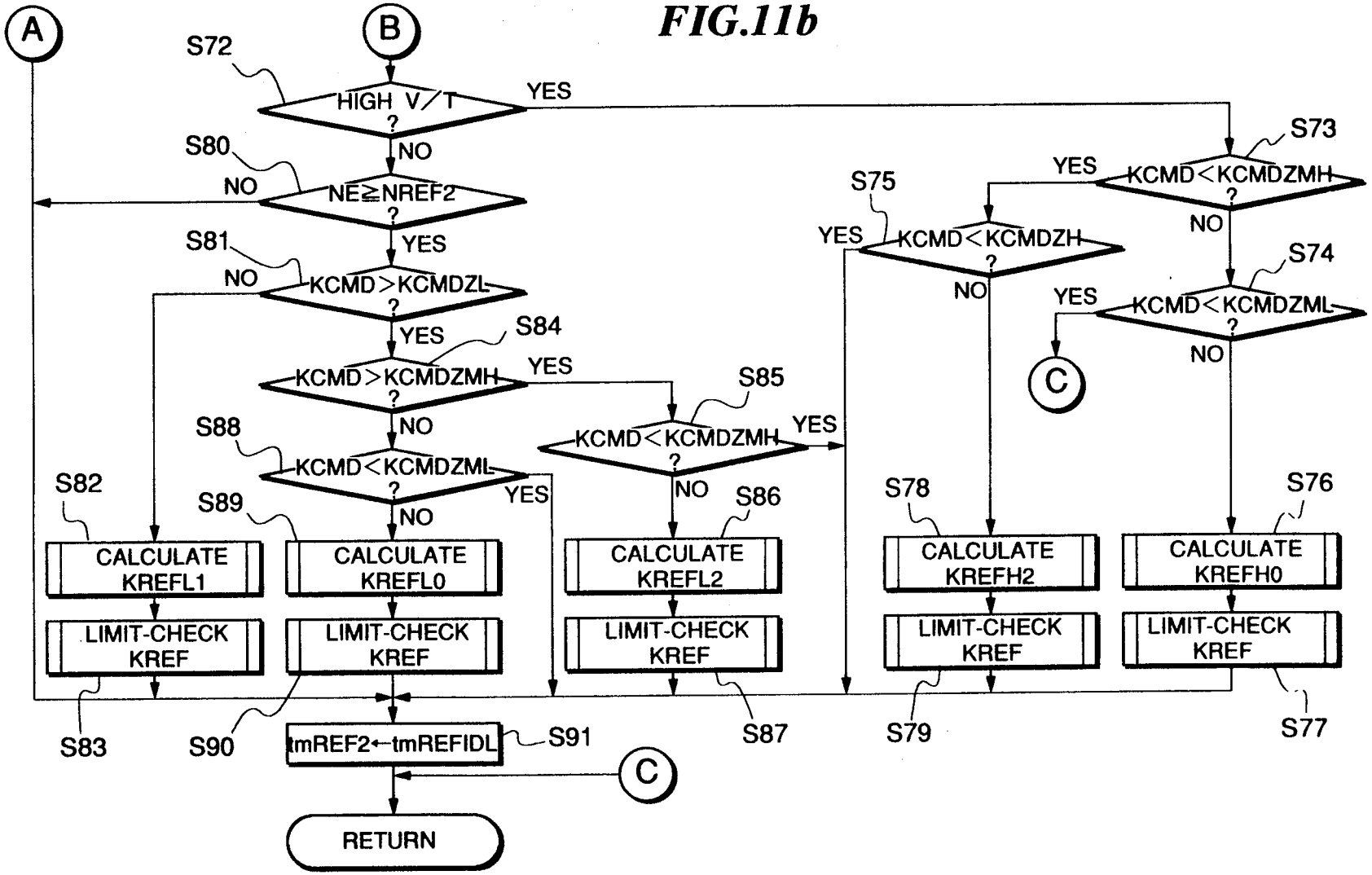

FIG. 8 shows a program for calculating the air-fuel ratio correction coefficient KLAF and the learned value KREF, in which at steps S101 and S102 programs shown in FIG. 9-11 are executed. More specifically, at the step S101, an integral term KLAFI2 of the air-fuel ratio correction coefficient KLAF for detecting sensor deterioration is calculated based upon the desired air-fuel ratio coefficient KCMD which is set in response to operating conditions of the engine and the detected air-fuel ratio KACT1 before deterioration correction, and then a learned value KREF2 (specifically, KREF2L0, KREF2L1, and KREF2L2 applied in the program of FIG. 5) is calculated by the use of the calculated integral term KLAFI2.

If the step S102, the value KLAF and the learned value KREF1 are calculated based upon the desired air-fuel ratio coefficient KCMD applied at the step S101 and the detected air-fuel ratio KACT2 after deterioration correction, to thereby calculate the fuel injection period $T_{OUT}$ by the equation (1) referred to before, for control of the air-fuel ratio.

As noted above, the learned value KREF2 for detection of sensor deterioration and the learned value KREF1 for air-fuel ratio control are calculated separately from each other. This is based upon the following ground: If the LAF sensor 15 has once been detected as deteriorated and then deterioration correction of the sensor output VAF has been started, sensor deterioration can no more be detected with accuracy by the use of the learned value KREF1 which is then calculated based upon the detected air-fuel ratio KACT2 after deterioration correction. Therefore, according to this embodiment, the learned value KKEF2 for sensor deterioration correction is calculated separately from the learned value KREF1 for air-fuel ratio control. By virtue of using the learned value KREF2, for example, it is possible to detect deterioration of the sensor with accuracy even in the case where once the sensor shows an output characteristic along the broken line in FIG. 4 due to temporary deposition of carbon or the like and shortly after that it becomes normal. Thus, it can be avoided that the sensor output is wrongly corrected by the sensor output coefficients KAFR, KAFL even when the sensor is normal.

In explaining portions of the programs of FIGS. 9-11 corresponding to execution of the step S101 in FIG. 8, symbols KACT, KLAFI and KREF should be taken for KACT1, KLAFI2 and KREF2, respectively. Also in explaining portions of the programs corresponding to the step S102 in FIG. 8, symbols KACT and KREF should be taken for KACT2 and KREF1, respectively.

Thus, KREF2L0, KREF2L1 and KREF2L2 for detection of sensor deterioration are calculated at steps S89, S82 and S86, respectively.

The program of FIG. 9 is executed in synchronism with generation of each TDC signal pulse.

At a step S1 in FIG. 9, it is determined whether the engine rotational speed NE is higher than a predetermined upper limit NLAFH (e.g. 6,500 rpm,). If the answer is affirmative (YES), i.e. NE>NLAFH, the integral term KLAFI used for calculation of the air-fuel ratio correction coefficient KLAF applied during air-fuel ratio feedback control by a program in FIG. 10 and the connection coefficient KLAF are both set to a first high speed valve timing learned value KREFH0, at a step S20, and a flag FLAFFB, which is set to 1 during air-fuel ratio feedback control, is set to 0, followed by termination of the present program. The learned value KREFH0 is learned value of the air-fuel ratio correction coefficient which is calculated when the desired air-fuel ratio is equal to or in the vicinity of the stoichiometric air-fuel ratio in high speed valve timing-selected mode by a program in FIG. 11.

If the answer to the question of the step S1 is negative (NO), i.e. if NE≦NLAFH, it is determined whether increase of the fuel amount (fuel increase) is being carried out after the start of the engine, at a step S2. If the answer is negative (NO), it is determined whether the engine coolant temperature TW is equal to or lower than a predetermined value TWLAF (e.g. −25° C.), at a step S3. If the step S2 or S3 provides an affirmative answer (YES), the values KLAFI and KLAF are both set to a first low valve timing learned value KREFL0, at a step S21, and then the program proceeds to a step S22. The learned value KREFL0 is learned value of the air-fuel ratio correction coefficient calculated when the desired air-fuel ratio is equal to or in the vicinity of the stoichiometric air-fuel ratio in low valve timing-selected mode, by the program of FIG. 11.

If the answer to the question of the step S3 is negative (NO), i.e. TW>TWLAF, it is determined whether a flag FWOT, which is set to a value of 1 while the engine is in a predetermined high load operating condition, has the value of 1, at a step S4. If the answer is negative (NO), i.e. FWOT=0 and accordingly the engine is not in the predetermined high load operating condition, the program jumps to a step S9, whereas if the answer is affirmative (YES), i.e. FWOT=1, it is determined whether the engine rotational speed NE is higher than a predetermined value NLAFWOT (e.g. 5,000 rpm). If the answer to the step S5 is negative (NO), i.e. NF<NLAFWOT, it is determined whether the desired air-fuel ratio coefficient KCMD is larger than a predetermined value KCMDWOT (e.g. a value corresponding to A/F=12.5), at a step S6. If the answer is negative (NO), i.e. KCMD≦KCMDWOT, it is determined whether the engine is in a high coolant temperature and enriching region where fuel increase should be effected, at a step S7.

If any of the steps S5-S7 provides an affirmative answer (YES), i.e. NE≧NLAFWOT or KCMD>KCMDWOT, or the engine is in the high coolant temperature and enriching region, the values KLAFI and KLAF are both set to a value of 1.0 at a step S8, and then the program proceeds to the step S22. If all the steps S5-S7 provide negative answers (NO), it is determined whether the engine rotational speed NE is equal to or lower than a predetermined lower limit NLAFL (e.g. 400 rpm), at a step S9. If the answer is negative (NO), i.e. NE>NLAFL, fuel cut (cutting-off of supply of fuel to the engine) is being carried out, at a step S10.

If either the step S9 or the step S10 provides an affirmative answer (YES), i.e. NE≧NLAFL, or if fuel cut being carried out, it is determined whether count value tmD in a KLAF holding timer which is set to a predetermined time period tmDHLD (e.g. 1 sec) during air-fuel feedback control, is a value of 0, at a step S14. If the answer is negative (NO), i.e. if tmD>0, that is, if the predetermined time period tmDHLD has not yet elapsed after the air-fuel ratio feedback control was interrupted, a value $KLAF_{(N)}$ of the air-fuel ratio correction coefficient in the present loop is set to a value $KLAF_{(N-1)}$ assumed in the last loop, at a step S15, and the flag FLAFFB is set to 0 at a step S16, followed by terminating the present program. If the answer to the question of the step S14 is affirmative (YES), i.e. tmD=0, that is, if the predetermined time period has elapsed, the values KLAFI and KLAF are both set to an idling learned value KREFIDL which is calculated while the engine is idling, by the FIG. 11 program, at steps S17 and S18, and the flag FLAFFB is set to 0, followed by terminating the program.

If the answers to the questions of the steps S9, S10 are both negative (NO), it is judged that the engine is in an operating region in which the air-fuel ratio feedback control can be effected (hereinafter referred to as "the feedback control region"), and then the KLAF holding timer tmD is set to the predetermined time period tmDHLD and started, at a step S11. Further, the KLAF value is calculated by the program of FIG. 10, and the flag FLAFFB is set to 1 at a step S13, followed by terminating the program.

FIG. 10 shows details of the program for calculating the air-fuel ratio correction coefficient KLAF which is executed at the step S12 in FIG. 9.

At a step S31 in FIG. 10, it is determined whether the flag FLAFFB assumed 1 at the time of generation of the immediately preceding TDC pulse (i.e. in the last loop of execution of the program of FIG. 9). If the answer is negative (NO), i.e. if the engine was not in the feedback control region and has first entered the same region in the present loop, the program proceeds to a step S32 where it is determined whether the engine is idling. If the answer to the step S32 is affirmative (YES), the values KLAFI and KLAF are both set to the idling learned value KREFIDL, at a step S34, and then the program proceeds to a step S35, whereas if the answer to the step S32 is negative (NO), the values KLAFI and KLAF are both set to the first low speed valve timing learned value KREFL0, at a step S33, followed by the program proceeding to the step S35.

At the step S35 an immediately preceding value $DKAF_{(N-1)}$ of the difference between the desired air-fuel ratio coefficient KCMD and the equivalent ratio (detected air-fuel ratio KACT indicative of an air-fuel ratio detected by the LAF sensor 15 is set to a value of 0, and a thinning-out TDC variable NITDC is set to a value of 0, followed by terminating the present program. The thinning-out TDC variable NITDC is used to renew the air-fuel ratio correction coefficient KLAF whenever TDC signal pulses equal in number to a thinning-out number NI are generated. If the answer to the question of a step S37, hereinafter referred to, is affirmative (YES), i.e. NITDC=0, the program proceeds to a step S40, where renewal of the KLAF value is carried out.

If the answer to the question of the step S31 is affirmative (YES), i.e. FLAFFB=1, which means that the engine was also in the feedback control region in the last loop, the difference $DKAF_{(N)}$ between the detected air-fuel ratio and the desired air-fuel ratio is calculated by subtracting a present value $KACT_{(N)}$ of the detected air-fuel ratio from an immediately preceding value $KCMD_{(N-1)}$ of the desired air-fuel ratio coefficient, at a step S36. Then, at a step S37, it is determined whether the thinning-out TDC variable NITDC has a value of 0.

If the answer is negative (NO), i.e. NITDC>0 the value NITDC is decreased by a decrement of 1 at a step S38, and the present value $DKAF_{(N)}$ of the above difference is set to the immediately preceding value $DKAF_{(N-1)}$ at a step S39, followed by terminating the program.

If the answer to the question of the step S37 is affirmative (YES), calculations are made of a proportional term (P term) coefficient KP, an integral term (I term) coefficient KI, a differential term (D term) coefficient KD, and the thinning-out number NI, at a step S40. The values KP, KI, KD and NI are set to respective predetermined values in each of a plurality of engine operating regions defined by engine rotational speed NE, intake pipe absolute pressure PBA, etc. Therefore, values of KP, KI, KD and NI are read out which correspond to detected engine operating regions.

At a step S41, it is determined whether the absolute value of the difference DKAF calculated at the step S36 is smaller than a predetermined value DKPID. If the answer is negative (NO), i.e. |DKAF|>DKPID, the program proceeds to the step S35, whereas if the answer is affirmative (YES), i.e. |DKAF|≦DKPID, the program proceeds to a step S42. At the step S42, the P term KLAFP, I term KLAFI and D term KLAFD are calculated by the following equations (4)-(6):

$$KLAFP = DKAF_{(N)} \times KP \quad (4)$$

$$KLAFI = KLAFI + DKAF_{(N)} \times KI \quad (5)$$

$$KLAFD = (DKAF_{(N)} - DKAF_{(N-1)}) \times KD \quad (6)$$

At the following steps S43-S46, limit checking of the I term KLAFI calculated above is effected. Specifically, the calculated value KLAFI is compared with predetermined upper and lower limits LAFIH and LAFIL at the steps S43, S44. If the value KLAFI exceeds the upper limit LAFIH, the former is set to the latter (step S45), and if the value KLAFI falls below the lower limit LAFL, the former is set to the latter (step S46).

At the following step S47, the PID terms KLAFP, KLAFI, and KLAFD calculated as above are added together to calculate the air-fuel ratio correction coefficient KLAF. Then, the present value $DKAF_{(N)}$ of the difference calculated above is set to the immediately preceding value $DKAF_{(N-1)}$ at a step S48, and further the thinning-out TDC variable NITDC is set to the thinning-out number NI calculated at the step S10, at a step S49, followed by the program proceeding to steps S50 and S51.

At the step S50, limit checking of the KLAF value is effected, and at the step S51, calculation of the learned value KREF of the air-fuel ratio correction coefficient is carried out by the program of FIG. 11, followed by terminating the present program.

At steps S61-S65 in FIG. 11, determinations are made as to whether or not conditions for calculation of the learned value (hereinafter referred to as "the learned value calculating conditions") are satisfied. More specifically, it is determined whether the engine rotational speed NE is lower than a predetermined high rotational speed NKREF (e.g. 6,000 rpm), at a step S61, whether the engine coolant temperature TW is equal to or higher than a predetermined value TWREF (e.g. 75° C.) at a step S62, whether a predetermined time period has elapsed after termination of fuel cut at a step S63, whether the intake temperature TA is lower than a predetermined value TAREF (e.g. 60° C.) at a step S64, and whether the present value of the desired air-fuel ratio coefficient KCMD is equal to the immediately preceding value at a step S65. If the answer of any of the steps S61-S65 is negative (NO), it is judged that the learned value calculating conditions are not satisfied, and then a timer tmREF1, which counts time elapsed after fulfillment of the learned value calculating conditions, is set to a predetermined time period tmREF (e.g. 1.5 sec) and started at a step S66, and then the program proceeds to a step S91.

The determination of the step S62 is provided for the following reason: When the engine coolant temperature is low, fuel injected into the intake pipe is drawn into the combustion chamber without being fully atomized, so that a misfire can occur or the engine rotation can become unstable. As a result, accurate detection of the air-fuel ratio cannot be effected by the LAF sensor.

The determination of the step S64 is provided for the following reason: When the intake temperature is high, the charging efficiency of the engine lowers so that the supply air-fuel ratio is deviated to a rich value with respect to a desired value.

Therefore, by inhibiting calculation of the learned value at a low engine coolant temperature and at a high intake temperature, it can be prevented that the detected air-fuel ratio varies with a change in the engine temperature, leading to a deviation in the learned value calculated.

On the other hand, if all the answers to the questions of the steps S61-S65 are affirmative (YES), it is judged that the learned value calculating conditions are satisfied, and then it is determined whether the count value of the timer tmREF1 is equal to 0, at a step S67. If the answer is negative (NO), i.e. if tmREF1>0, that is, the predetermined time period tmREF has not yet elapsed after fulfillment of the learned value calculating conditions, the program directly proceeds to the step S91, without executing calculation of the learned value. Thereafter, when the answer to the step S67 becomes affirmative (YES), i.e. the predetermined time period tmREF has elapsed, the steps S68 et seg. are executed to carry out calculation of the learned value in response to operating conditions of the engine.

The reason why calculation of the learned value is inhibited until the predetermined time period tmREF elapses even after fulfillment of the learned value calculating condition is as follows: There is a time lag between the time a mixture is supplied into the intake system and the time the resulting air-fuel ratio caused by burning of the supplied mixture is detected in the exhaust system. As a result, in the case where the desired air-fuel ratio is changed from 16 to 22, for example, if the learned value is calculated immediately upon such change, the air-fuel ratio corresponding to the desired air-fuel ratio set to 16 is detected in the exhaust system, and accordingly the learned value is calculated as a learned value corresponding to the desired air-fuel ratio set to 22 by using a KLAF value calculated based upon the above detected air-fuel ratio. Consequently, the calculated learned value corresponding to the desired air-fuel ratio set to 22 assumes a learner or smaller value than the proper value. Particularly, if the desired air-fuel ratio is set to a value learner than the stoichiometric air-fuel ratio, the learned value is deviated to a further learner value, which can result in a misfire if the deviated learned value is applied.

Therefore, according to this embodiment, even when the condition that the desired air-fuel ratio coefficient KCMD is the same as one applied in the last loop is satisfied, calculation of the learned value is inhibited over the predetermined time period tmREF, to thereby avoid the above-mentioned inconvenience.

At the step S68, it is determined whether the engine is idling. This determination is carried out based upon detected values of engine rotational speed WE, intake pipe absolute pressure PBA and throttle value opening $\theta$TH, for example. If the answer to the step S68 is affirmative (YES), it is determined whether a timer tmREF2, which is set to a predetermined time period tmREFIDL (e.g. 3 sec) and started at the step S91, to measure time elapsed after transition to the idling condition, has a count value of 0, at a step S69. If the answer is negative (NO), i.e. the predetermined time period tmREFIDL has not elapsed, the present program is immediately terminated without carrying out calculation of the learned value. When the predetermined time period tmREFIDL has elapsed (the answer to the step S69 is affirmative or YES), the idling learned value KREFIDL is calculated at a step S70, followed by limit checking of the calculated value KREFIDL at a step S71 and then terminating the program.

By thus inhibiting calculation of the idling learned value KREFIDL within a predetermined time period after transition into an idling condition, a deviation in the idling learned value KREFIDL can be avoided. More specifically, in the case where the engine is decelerated into an idling state, the engine undergoes an unstable condition, for example, the flow velocity of the mixture is high immediately after the transition into an idling state, fuel adhering to the inner wall of the intake pipe is drawn into the combustion chamber, and a misfire can occur, whereby accurate detection of the air-fuel ratio commensurate with the supply air-fuel ratio is impossible to carry out. Therefore, in this embodiment, calculation of the learned value is started upon the lapse of the predetermined time period after the transition into the idling state, to thereby enable to obtain a value of the air-fuel ratio correction coefficient based upon the detected air-fuel ratio obtained in a stable engine condition and hence prevent a deviation in the learned value.

At the step S70, the learned value KREF is calculated by the following equation (7):

$$KREF = \frac{CREF}{65536} \times KLAFI + \frac{65536 - CREF}{65536} \times KREF_{(N-1)} \quad (7)$$

where CREF represents a variable which is set to an appropriate value dependent on engine operating conditions within a range of 1-65536, and $KREF_{(N-1)}$ an immediately preceding value of the learned value KREF.

According to the equation (7), the learned value KREF is calculated as an average value of the integral term KLAFI. Since the integral value KLAFI becomes almost equal to the value of the correction coefficient KLAF when calculated in a steady engine operating condition. Therefore, the learned value KREF calculated by the equation (7) can be substantially regarded as an average value of the KLAF value.

The limit checking at the step S71 is effected by comparing the calculated learned value with predetermined upper and lower limits, and setting the learned value to the upper limit or the lower limit if the calculated learned value falls outside the range defined by the upper and lower limits.

If the answer to the question of the steps S68 is negative (NO), i.e. if the engine is not idling, it is then determined whether the selected valve timing is high speed valve timing, at a step S72. If the answer is negative (NO), i.e. low speed valve timing is selected, it is determined whether the engine rotational speed NE is equal to or higher than a predetermined low value NREF2 (e.g. 500 rpm), at a step S80. If the answer is negative (NO), i.e. NE<NREF2, the program jumps to the step S91 without effecting calculation of the learned value. If the answer to the step S80 is affirmative (YES), i.e. NE≧NREF2, steps S81–S90 are executed to carry out calculation of the learned value (steps S82, S86, and S89) in each of three ranges (L1)–(L3) defined by the relationships between the desired air-fuel ratio coefficient KCMD and first to fourth predetermined air-fuel ratio values KCMDZL, KCMDZML, KCMDZMH, and KCMDZH (steps S82, S86, and S89), and limit checking of the calculated learned value (steps S83, S87, and S90), followed by the program proceeding to the step S91.

The first to fourth predetermined air-fuel ratio values KCMDZL, KCMDZML, KCMDZMH, and KCMDZH are set, respectively, to values corresponding to 20.0, 15.0, 14.3, and 13.0 in such a relationship that KCMDZL<KCMDZML<KCMDZMH<KCMDZH:

(L1) a range in which KCMD≦KCMDZL (the answer to the step S81 is negative or No):

A "lean-burn" learned value KREFL1 is calculated by the equation (7) when low speed valve timing is selected and the desired air-fuel ratio is set to a learner value than the stoichiometric air-fuel ratio (this state corresponds to a state in which the LAF sensor output value VAF is equal or close to the value VAF2);

(L2) a range in which KCMDZML≦KCMD≦KCMDZMH (the answer to the step S81 is affirmative or YES, and at the same time the answers to the steps S84, S88 are both negative NO):

The first low speed valve timing learned value KREFLO is calculated by the equation (7) when low speed valve timing is selected and the desired air-fuel ratio is equal or close to the stoichiometric air-fuel ratio (this state corresponds to a state in which the sensor output valve VAF is equal or close to the value VAFO);

(L3) a range in which KCMD≧KCMDZH (the answers to the steps S81, S84 are both affirmative or YES and at the same the answer to the step S85 is negative or NO):

A second low valve timing learned value KREFL2 is calculated by the equation (7) when low speed valve timing is selected and the desired air-fuel ratio is equal or close to a value corresponding to the predetermined high load operating condition (this state corresponds to a state in which the sensor output value VAF is equal or close to the value VAF1).

On the other hand, in a range in which KCMDZL<KCMD<KCMDZML (the answer to the step S88 is affirmative or YES) and in a range in which KCMDZMH<KCMD<KCMDZH (the answer to the step S85 is affirmative or YES), the program jumps to the step S91 without effecting calculation of the learned value.

If the step S91, the timer tmREF2 is set to the predetermined time period tmREFIDL and started, followed by terminating the program.

If the answer to the question of the step S72 is affirmative (YES), i.e. if high speed valve timing is selected, steps S73–S79 are executed to carry out calculation of the learned value (steps S76, S78) in each of two ranges (H1) and (H2) defined by the relationships between the desired air-fuel ratio coefficient KCMD and the second to fourth predetermined air-fuel ratio values KCMDZML, KCMDZMH, and KCMDZH, and limit checking of the calculated learned value (steps S77, S79), followed by the program processing to step S91:

(H1) a range in which KCMDZML≦KCMD≦KCMDZMH (the answers to the steps S73, S74 are both negative or NO):

The first high speed valve timing learned value KREFHO is calculated by the equation (7) when high speed valve timing is selected and the desired air-fuel ratio is equal or close to the stoichiometric air-fuel ratio;

(H2) a range in which KCMD≧KCMDZH (the answer to the step S73 is affirmative or YES and at the same time the answer to the step S75 is negative or NO):

A second high speed valve timing learned value KREFH2 is calculated by the equation (7) when high speed valve timing is selected and the desired air-fuel ratio is equal or close to the value corresponding to the predetermined high load operating condition.

On the other hand, in a range in which KCMD<KCMDZML (the answer to the step S74 is affirmative or YES) and in a range in which KCMDZMH<KCMD<KCMDZH (the answer to the step S75 is affirmative or YES, the program jumps to the step S91 without calculating the learned value.

The invention is not limited to the above specific embodiments, but any variations and modifications thereof are possible within the scope of the appended claims.

What is claimed is:

1. A method of detecting deterioration of an exhaust gas ingredient concentration sensor for use in controlling an air-fuel ratio of a mixture supplied to an internal combustion engine having an exhaust system in which said sensor is arranged, said sensor having an output characteristic approximately proportional to concentration of a specific ingredient in exhaust gases emitted from said engine, said air-fuel ratio being feedback-controlled to a desired air-fuel ratio by calculating an amount of fuel supplied to said engine by the use of a desired air-fuel ratio coefficient indicative of said desired air-fuel ratio and set in dependence on operating conditions of said engine, and an air-fuel ratio correction coefficient set in dependence on a value of an output from said sensor and said desired air-fuel ratio coefficient, the method comprising the steps of:

(1) calculating a plurality of average values of said air-fuel ratio correction coefficient, respectively, when said desired air-fuel ratio falls within a plurality of predetermined ranges;

(2) comparing between said average values thus calculated: and (3) determining a degree of deterioration of said sensor from results of said comparison.

2. A method as claimed in claim 1, wherein said predetermined ranges of said desired air-fuel ratio include a first predetermined range corresponding to a stoichiometric air-fuel ratio, a second predetermined range lying on a rich side with respect to said stoichiometric air-fuel ratio, and a third predetermined range lying on a lean side with respect to said stoichiometric air-fuel ratio, said average values of said air-fuel ratio correction coefficient including first, second and third average values calculated, respectively, when said desired air-fuel ratio falls within said first, second and third predetermined ranges, said step (2) comprising comparing between a first average value of said air-fuel ratio correction coefficient and a second average value thereof, and comparing between said first average value of said air-fuel ratio correction coefficient and a third average value thereof.

3. A method as claimed in claim 2, wherein said step (2) comprises calculating a first ratio between said first average value and said second average value, and a second ratio between said first average value and said third average value, and comparing said first and second ratios thus calculated with respective predetermined values.

4. A method as claimed in claim 2, wherein said step (2) comprises calculating a first difference between said first average value and said second average value, and a second difference between and first average value and said third average value, and comparing said first and second differences thus calculated with respective predetermined values.

5. A method as claimed in claim 1, wherein said exhaust gas ingredient concentration sensor comprises at least one oxygen-pumping element and at least one cell element, each being composed of a solid electrolytic material having ion conductivity, and a couple of electrodes between which said solid electrolytic material is interposed, a diffusion restricting zone being defined between said oxygen-pumping element and said cell element.

6. A method of controlling an air-fuel ratio of a mixture supplied to an internal combustion engine having an exhaust system, and an exhaust gas ingredient concentration sensor arranged in said exhaust system, said sensor having an output characteristic approximately proportional to concentration of a specific ingredient in exhaust gases emitted from said engine, said air-fuel ratio being feedback-controlled to a desired air-fuel ratio by calculating an amount of fuel supplied to said engine by the use of a desired air-fuel ratio coefficient indicative of said desired air-fuel ratio and set in dependence on operating conditions of said engine, and an air-fuel ratio correction coefficient set in dependence on a value of an output from said sensor and said desired air-fuel ratio coefficient, the method comprising the steps of:

(1) calculating a plurality of average values of said air-fuel ratio correction coefficient, respectively, when said desired air-fuel ratio falls within a plurality of predetermined ranges;

(2) comparing between said average values thus calculated:

(3) determining a degree of deterioration of said sensor from results of said comparison; and (4) correcting the value of said output from said sensor in response to the degree of deterioration thus determined.

7. A method as claimed in claim 6, wherein said predetermined ranges of said desired air-fuel ratio include a first predetermined range corresponding to a stoichiometric air-fuel ratio, a second predetermined range lying on a rich side with respect to said stoichiometric air-fuel ratio, and a third predetermined range lying on a lean side with respect to said stoichiometric air-fuel ratio, said average values of said air-fuel ratio correction coefficient including first, second and third average values calculated, respectively, when said desired air-fuel ratio falls within said first, second and third predetermined ranges, said step (2) comprising comparing between a first average value of said air-fuel ratio correction coefficient and a second average value thereof, and comparing between said first average value of said air-fuel ratio correction coefficient and a third average value thereof.

8. A method as claimed in claim 7, wherein said step (2) comprises calculating a first ratio between said first average value and said second average value, and a second ratio between said first average value and said third average value, and comparing said first and second ratios thus calculated with respective predetermined values.

9. A method as claimed in claim 7, wherein said step (2) comprises calculating a first difference between said first average value and said second average value, and a second difference between and first average value and said third average value, and comparing said first and second differences thus calculated with respective predetermined values.

10. A method as claimed in claim 6, wherein said step (4) comprises determining first and second sensor output correction coefficients for correcting the value of said output from said exhaust gas ingredient concentration sensor, respectively, on a rich side and on a lean side with respect to a stoichiometric air-fuel ratio, and correcting the value of said output from said sensor by the determined first and second sensor output correction coefficients, when the determined degree of deterioration of said sensor is larger than a predetermined value.

11. A method as claimed in claim 6, including the step of calculating said amount of fuel supplied to said engine by using average values of said air-fuel ratio correction coefficient in place of said air-fuel ratio correction coefficient when said engine is in predetermined operating regions, said average values for calculation of said amount of fuel being calculated separately from said average values calculated for determination of the degree of deterioration at said step (1).

12. A method as claimed in claim 6, wherein said exhaust gas ingredient concentration sensor comprises at least one oxygen-pumping element and at least one cell element, each being composed of a solid electrolytic material having ion conductivity, and a couple of electrodes between which said solid electrolytic material is interposed, a diffusion restricting zone being defined between said oxygen-pumping element and said cell element.

13. A method of detecting deterioration of an exhaust gas ingredient concentration sensor for use in controlling an air-fuel ratio of a mixture supplied to an internal combustion engine having an exhaust system in which said sensor is arranged, said sensor having an output characteristic approximately proportional to concentration of a specific ingredient in exhaust gases emitted from said engine, said air-fuel ratio being feedback-controlled to a desired air-fuel ratio set in dependence on operating conditions of said engine by calculating an amount of fuel supplied to said engine by the use of an air-fuel ratio correction value set in dependence on a value of an output from said sensor, the method comprising the steps of:

(1) calculating a plurality of average values of said air-fuel ratio correction value, respectively, when said desired air-fuel ratio falls within a plurality of predetermined ranges;

(2) comparing between said average values thus calculated: and (3) determining a degree of deterioration of said sensor from results of said comparison.

14. A method of controlling an air-fuel ratio of a mixture supplied to an internal combustion engine having an exhaust system, and an exhaust gas ingredient concentration sensor arranged in said exhaust system, said sensor having an output characteristic approximately proportional to concentration of a specific ingredient in exhaust gases emitted from said engine, said air-fuel ratio being feedback-controlled to a desired air-fuel ratio set in dependence on operating conditions of said engine by calculating an amount of fuel supplied to said engine by the use of an air-fuel ratio correction value set in dependence on a value of an output from said sensor, the method comprising the steps of:

(1) calculating a plurality of average values of said air-fuel ratio correction value, respectively, when said desired air-fuel ratio falls within a plurality of predetermined ranges;

(2) comparing between said average values thus calculated:

(3) determining a degree of deterioration of said sensor from results of said comparison; and (4) correcting the value of said output from said sensor in response to the degree of deterioration thus determined.

* * * * *